US010522308B2

(12) United States Patent
Noh et al.

(10) Patent No.: US 10,522,308 B2
(45) Date of Patent: Dec. 31, 2019

(54) MULTI-OPERATING SWITCH UNIT FOR VEHICLES

(71) Applicant: LS AUTOMOTIVE TECHNOLOGIES CO., LTD., Anyang-si, Gyeonggi-do (KR)

(72) Inventors: Sam Jong Noh, Incheon (KR); Dae Woo Kwon, Suwon-si (KR); Gun Wook Go, Seoul (KR)

(73) Assignee: LS AUTOMOTIVE TECHNOLOGIES CO., LTD., Anyang-si, Gyeonggi-do (KR)

( * ) Notice: Subject to any disclaimer, the term of this patent is extended or adjusted under 35 U.S.C. 154(b) by 39 days.

(21) Appl. No.: 15/771,766

(22) PCT Filed: Oct. 28, 2016

(86) PCT No.: PCT/KR2016/012293

§ 371 (c)(1),
(2) Date: Oct. 1, 2018

(87) PCT Pub. No.: WO2017/074120

PCT Pub. Date: May 4, 2017

(65) Prior Publication Data

US 2019/0115173 A1 Apr. 18, 2019

(30) Foreign Application Priority Data

Oct. 30, 2015 (KR) ..... 10-2015-0152116
Oct. 27, 2016 (KR) ..... 10-2016-0140989

(51) Int. Cl.
*H01H 25/04* (2006.01)
*G05G 9/047* (2006.01)
(Continued)

(52) U.S. Cl.
CPC ..... *H01H 25/04* (2013.01); *G05G 9/047* (2013.01); *H01H 25/06* (2013.01);
(Continued)

(58) Field of Classification Search
CPC ..... H01H 25/04; H01H 25/06; H01H 19/11; G05G 9/047
(Continued)

(56) References Cited

U.S. PATENT DOCUMENTS 6,348,664 B2 2/2002 Kozuma
6,713,896 B1 3/2004 Burtscher et al.
(Continued)

FOREIGN PATENT DOCUMENTS

CN 104885177 A 9/2015
JP 05006616 U 1/1993
(Continued)

*Primary Examiner* — Edwin A. Leon
*Assistant Examiner* — Iman Malakooti
(74) *Attorney, Agent, or Firm* — Rabin & Berdo, P.C.

(57) ABSTRACT

Provided is a multi-operating switch device for a vehicle, including: a housing unit; a substrate; a switch shaft unit; a rotary switch unit; a directional switch unit; and a push switch unit. The directional switch unit includes: a directional slide part within the housing unit; a directional switch disposed on the substrate, and configured to be operated by a change in the position of the directional slide part to generate a signal indicating the change in the position of the directional slide part; and a directional return part. The directional switch includes: a directional switch housing; and a directional switch knob partially exposed to the outside from one surface of the directional switch housing to contact with the directional slide part so that when the directional switch knob is pressedly rotated pivotally about an axis parallel with the substrate, it is received in the directional switch housing.

20 Claims, 22 Drawing Sheets

(51) Int. Cl.
*H01H 25/06* (2006.01)
*H01H 19/11* (2006.01)

(52) U.S. Cl.
CPC ... *G05G 2009/04744* (2013.01); *H01H 19/11* (2013.01); *H01H 2231/026* (2013.01)

(58) Field of Classification Search
USPC ..... 200/6 A
See application file for complete search history.

(56) References Cited

U.S. PATENT DOCUMENTS

| | | | | |
|---|---|---|---|---|
| 9,536,689 | B2 | 1/2017 | Noh et al. | |
| 2005/0284737 | A1* | 12/2005 | Shitanaka | H01H 25/04 200/5 R |
| 2009/0008233 | A1 | 1/2009 | Saomoto | |
| 2016/0055992 | A1* | 2/2016 | Yamanaka | H01H 19/14 200/292 |

FOREIGN PATENT DOCUMENTS

| | | | |
|---|---|---|---|
| JP | H1021788 | A | 1/1998 |
| JP | 2001-351478 | A | 12/2001 |
| JP | 2004079308 | A | 3/2004 |
| JP | 2007052963 | A | 3/2007 |
| JP | 2009-016114 | A | 1/2009 |
| JP | 3157281 | U | 2/2010 |
| JP | 2011146177 | A | 7/2011 |
| JP | 2013182663 | A | 9/2013 |
| KR | 10-2008-0066601 | A | 7/2008 |
| KR | 10-2010-0028777 | A | 3/2010 |
| KR | 10-2011-0032600 | A | 3/2011 |
| KR | 10-1091273 | B1 | 12/2011 |
| KR | 10-1096925 | B1 | 12/2011 |
| KR | 10-2012-0039188 | A | 4/2012 |
| KR | 10-2013-0066416 | A | 6/2013 |
| KR | 10-1514154 | B1 | 4/2015 |

* cited by examiner

MULTI-OPERATING SWITCH UNIT FOR VEHICLES

TECHNICAL FIELD

The present invention relates to a switch installed in a vehicle, and more particularly, to a vehicular switch which implements a combined operation thereof through a simple and compact structure.

BACKGROUND ART

In general, a steering wheel assembly for vehicles includes a steering wheel, a steering column, a steering roll connector assembly, and a multi-function switch assembly. The steering wheel is intended to allow a driver to set the steering direction. The rotation of the steering wheel by the driver is transferred to vehicle wheels through the steering column so that the steering angle of the vehicle is set. In addition, a vehicle such as an automobile requires functions of various kinds of convenient means for offering a more stable and comfortable driving state, beyond a function of the vehicle as a means of transportation.

For example, the steering wheel of a vehicle which is recently produced includes a window switch for opening or closing a window, a steering light switch for turning on or off a steering light, an audio switch for driving an audio device, and a wiper switch for driving a wiper. The multi-function switch assembly includes a light and a fog lamp, a wiper, various audio devices, and a vehicle window switch, and the like. The multi-functional switch assembly serves to prevent the driver's driving attention from being dissipated even during manipulation of a wide variety of devices by increasing the manipulability of the various devices. The multi-functional switch assembly is implemented as a button switch mounted on a top of the steering wheel, or a vehicular lever switch mounted on a side of the steering wheel. Further, various functions are concentrated on a console switch.

The switch of the vehicle follows a recent trend toward an intensive combination of switches having various functions. The structure of the vehicular switch becomes more complicated in proportion to an increase in functions of the switch, thus leading to an increase in the possibility of erroneous operation of the switch.

DISCLOSURE OF INVENTION

Technical Problem

Accordingly, the present invention has been made to solve the above-mentioned problems occurring in the prior art, and it is an object of the present invention to provide a multi-operating switch device for a vehicle, which can implement a combined operation thereof through a simple and compact structure so that durability can be enhanced and a more accurate operation can be achieved.

Technical Solution

To achieve the above object, in one aspect, the present invention provides a multi-operating switch device for a vehicle, including: a housing unit; a substrate disposed within the housing unit; a switch shaft unit movably disposed so as to be received at one end thereof in the housing unit and exposed at the other end thereof to the outside of the housing unit; a rotary switch unit configured to detect the axial rotation of the switch shaft unit and output a signal indicating the detection of the axial rotation; a directional switch unit configured to detect a tilting directional operation of the switch shaft unit and output a signal indicating detection of the tilting directional operation; and a push switch unit configured to detect a pressure type push operation of the switch shaft unit and output a signal indicating the detection of the pressure type push operation, wherein the directional switch unit includes: a directional slide part configured to be changed in position within the housing unit by the tilting directional operation of the switch shaft unit; a directional switch disposed on the substrate, and configured to be operated by a change in the position of the directional slide part to generate a signal indicating the change in the position of the directional slide part; and a directional return part configured to return the directional slide part and the switch shaft unit to their original positions on a plane, and wherein the directional return part includes: a return plunger movably disposed in the housing unit; a return elastic part received in the housing unit and configured to elastically support the return plunger; and a return groove configured to form a continuous contact with the return plunger and including a position for returning the return plunger to its original position, and wherein the return plunger is movable in an axial direction of the switch shaft unit with respect to the housing unit, and the return groove is formed in the directional slide part.

In the multi-operating switch device for a vehicle, the housing unit may include; a housing base configured to support the substrate; and a housing cover engaged with the housing base to define an inner space therebetween, and including a return mounting part formed thereon to allow the return plunger to be movably disposed at the return mounting part.

In the multi-operating switch device for a vehicle, the direction slide part may include: a directional medium slide disposed between the housing base 130 and the housing cover in such a manner that the switch shaft unit penetrates through the direction medium slide; a directional bottom slide disposed between the directional medium slide and the housing base in such a manner as to penetratingly fit around the outer periphery of switch shaft unit; and a directional top slide formed on one surface of the housing cover 110 so as to be oriented toward the directional medium slide and configured to be engaged with the directional medium slide in a relatively movable manner.

In the multi-operating switch device for a vehicle, the directional medium slide may include: a medium upper guide formed on one surface thereof so as to be engageable with the direction top slide; and a medium lower guide formed on the other surface thereof so as to be engageable with a bottom guide formed on the directional bottom slide in a relatively movable manner.

In the multi-operating switch device for a vehicle, the directional bottom slide may include: a bottom slide body including the bottom guide formed on one surface thereof, and having a bottom through-hole formed at the center thereof to allow the switch shaft unit to penetrate therethrough in such a manner that the bottom through-hole is in close contact at the inner peripheral surface thereof with the switch shaft unit; a bottom slide side formed extending outwardly from a side of the bottom slide body and having the return groove formed thereon; and a bottom slide moving part formed below the bottom slide body and configured to move the directional switch.

In the multi-operating switch device for a vehicle, the medium upper guide and the medium lower guide may be arranged so as to cross each other at 90 degree angles on the same plane when viewed from the top by projection.

In the multi-operating switch device for a vehicle, the return groove may include: a groove stable portion configured to form a contact with a lower end of the return plunger in a normal state in which no external force is applied to the switch shaft body; and a groove moving portion is disposed at the outside of the groove stable portion so that when an external force is applied to the switch shaft unit to cause the switch shaft body the groove moving portion forms a contact with the lower end of the return plunger.

In the multi-operating switch device for a vehicle, the bottom slide moving part may be a projection formed protrudingly extending downwardly from the underside of the bottom slide body, and the direction switch may be a contact switch.

In the multi-operating switch device for a vehicle, the switch shaft unit may include: a switch shaft hinge disposed at one end thereof so as to be hingeably received within the housing unit and including a shaft hinge guide formed on the outer periphery thereof; and a switch shaft body of a predetermined length connected to the switch shaft hinge and configured to be exposed at one end thereof to the outside from the housing unit, and wherein the rotary switch unit may include: a rotary encoder disposed between the substrate and the housing unit and configured to at least partially receive the switch shaft hinge, the rotary encoder including a rotary encoder receiving guide formed on the inner periphery thereof so as to be engageable with the shaft hinge guide and a plurality of rotary encoder slits formed on the outer periphery thereof; and a rotary switch sensor disposed on the substrate so as to be spaced apart from the rotary encoder by a predetermined interval and configured to detect the number of movements of the rotary encoder slits when the rotary encoder is axially rotated together with the switch shaft unit.

In the multi-operating switch device for a vehicle, the rotary switch unit may further include a rotary detent part configured to detent the rotation of the rotary encoder.

In the multi-operating switch device for a vehicle, the rotary detent part may include: a rotary detent disposed on the underside of the rotary encoder; a rotary detent elastic means received in a rotary detent receiving part disposed in the housing unit; and a rotary detent ball elastically supported by the rotary detent elastic means to maintain a continuous contact with the rotary detent.

In the multi-operating switch device for a vehicle, the rotary detent part may include: a rotary detent disposed on a side of a lower portion of the rotary encoder; a leaf spring type rotary detent elastic means fixedly mounted to the housing unit to correspond to the rotary detent; and a rotary detent elastic protrusion formed integrally with the rotary detent elastic means so as to be bently protruded from the center of the rotary detent elastic means to maintain a continuous contact with the rotary detent.

In the multi-operating switch device for a vehicle, the rotary detent part may include: a rotary detent disposed on a side of a lower portion of the rotary encoder; a rotary detent elastic means received in a rotary detent receiving part disposed radially in the housing unit so as to be oriented toward the center of the switch shaft unit; and a rotary detent ball elastically supported by the rotary detent elastic means to maintain a continuous contact with the rotary detent.

In the multi-operating switch device for a vehicle, the push switch unit may include: a push detent disposed on an upper end of the rotary detent at a side of the lower portion of the rotary encoder to form a stacked-layer structure together with the rotary detent in a longitudinal direction of the switch shaft unit and a radial direction from the center of the switch shaft unit; a push moving part at least partially disposed on the rotary encoder, and configured to be vertically moved downwardly together with the rotary encoder when the switch shaft hinge of the switch shaft unit presses the rotary encoder to downwardly move the rotary encoder; and a push switch disposed on the substrate and configured to generate a signal indicating the change in the position of the push moving part When the push moving part is changed in position in a vertical direction.

In the multi-operating switch device for a vehicle, the rotary detent receiving part may further include a chamfered part formed at an upper end thereof, which is oriented toward the center of the housing unit to prevent an undesirable interference with the rotary encoder when the rotary encoder is vertically moved.

In the multi-operating switch device for a vehicle, the push switch unit may include: a push holder at least partially disposed below the rotary encoder and configured to be in close contact with the switch shaft hinge of the switch shaft unit so that when the switch shaft unit is vertically moved, the push holder is vertically moved together with the switch shaft unit; a push switch disposed on the substrate and configured to generate a signal indicating a change in position of the push holder when the push holder is changed in the position in a vertical direction; and a push return part disposed below the push holder and configured to elastically support the push holder.

In the multi-operating switch device for a vehicle, the push holder may include: a holder body configured to contactingly receive the switch shaft hinge; a holder extension formed extending outwardly from a side of the holder body; and a holder moving part formed upwardly extending from the holder extension in parallel with a vertical movement direction of the switch shaft unit so that when the switch shaft unit is vertically moved, the holder moving part moves the push switch.

In the multi-operating switch device for a vehicle, the push return part may include: a push return body configured to be in close contact with the holder body; a push return extension formed extending outwardly from a side of the push return body; and a push return rubber cap disposed on one surface of the push return extension and configured to elastically support the holder extension.

In the multi-operating switch device for a vehicle, each of the holder body and the push return body may include a through-hole formed at the center thereof, wherein the switch shaft hinge may include a shaft hinge stopper at a bottom surface thereof, wherein the housing unit may include a base push tolerance formed at a bottom surface thereof to correspond to the shaft hinge stopper, wherein when an external force may be applied to the switch shaft unit to perform a push operation, the shaft hinge stopper is received in the base push tolerance, and wherein when an external force is applied to the switch shaft unit to perform a tilting operation, the shaft hinge stopper may be brought into close contact with an outer surface of the base push tolerance to prevent from the shaft hinge stopper being received in the base push tolerance.

In another aspect, the present invention provides a multi-operating switch device for a vehicle, including: a housing unit; a substrate disposed within the housing unit; a switch shaft unit movably disposed so as to be received at one end thereof in the housing unit and exposed at the other end thereof to the outside of the housing unit; a rotary switch unit configured to detect the axial rotation of the switch shaft unit and output a signal indicating the detection of the axial rotation; a directional switch unit configured to detect a tilting directional operation of the switch shaft unit and output a signal indicating detection of the tilting directional operation; and a push switch unit configured to detect a pressure type push operation of the switch shaft unit and output a signal indicating the detection of the pressure type push operation, wherein the directional switch unit includes: a directional slide part configured to be changed in position within the housing unit by the tilting directional operation of the switch shaft unit; a directional switch disposed on the substrate, and configured to be operated by a change in the position of the directional slide part to generate a signal indicating the change in the position of the directional slide part; and a directional return part configured to return the directional slide part and the switch shaft unit to their original positions on a plane, and wherein the directional switch includes: a directional switch housing disposed on one surface of the substrate; and a directional switch knob disposed to be at least partially exposed to the outside from one surface of the directional switch housing so as to be in close contact with the directional slide part so that when the directional switch knob is pressedly rotated pivotally about one point at the inside of the directional switch housing, i.e., about an axis parallel with the substrate, it is received in the directional switch housing.

In the multi-operating switch device for a vehicle, the directional switch knob may be disposed radially from the center of the switch shaft unit and a rotational center of the directional switch knob, which is horizontal to the substrate may be positioned adjacent to an end of the directional switch knob in the longitudinal direction of the directional switch knob so as to be oriented toward the center of the switch shaft unit.

In the multi-operating switch device for a vehicle, the directional switch knob may include: a directional switch elastic part configured to provide an elastic restoring force to the directional switch knob in the directional switch housing; a directional switch movable contact configured to be moved by the directional switch knob; and a directional switch fixed contact disposed so as to be contactable with the directional switch movable contact when the directional switch movable contact is moved by the directional switch knob.

In still another aspect, the present invention provides a multi-operating switch device for a vehicle, including: a housing unit; a substrate disposed within the housing unit; a switch shaft unit movably disposed so as to be received at one end thereof in the housing unit and exposed at the other end thereof to the outside of the housing unit; a rotary switch unit configured to detect the axial rotation of the switch shaft unit and output a signal indicating the detection of the axial rotation; a directional switch unit configured to detect a tilting directional operation of the switch shaft unit and output a signal indicating detection of the tilting directional operation; and a push switch unit configured to detect a pressure type push operation of the switch shaft unit and output a signal indicating the detection of the pressure type push operation, wherein the switch shaft unit 300 includes: a switch shaft hinge 320 disposed at one end thereof so as to be hingeably received within the housing unit and including a shaft hinge guide 321 formed on the outer periphery thereof; and a switch shaft body 310 of a predetermined length connected to the switch shaft hinge 320 and configured to be exposed at one end thereof to the outside from the housing unit, and wherein the rotary switch unit 400 includes: a rotary block 410 disposed between the substrate 200 and the housing unit 100 and configured to at least partially receive the switch shaft hinge 320, the rotary block including a rotary block receiving guide 413 formed on the inner periphery thereof so as to be engageable with the shaft hinge guide 321 and a plurality of rotary block moving parts 415 circumferentially formed on an end thereof, which is oriented toward the substrate; and a rotary switch sensor 420 disposed on the underside of the substrate 200 so as to be brought into direct contact with the rotary block moving part 415 of the rotary block 410 and configured to be moved by a stepped portion of the rotary block moving part 415 when the rotary block 410 is axially rotated together with the switch shaft unit 300.

In the multi-operating switch device for a vehicle, the rotary switch unit 400 may further include a rotary detent part 430 configured to detent the rotation of the rotary block 410.

In the multi-operating switch device for a vehicle, the rotary detent part 430 may include: a rotary detent 431 disposed on the underside of the rotary block; a rotary detent elastic means 435 received in a rotary detent receiving part 131 disposed in the housing unit 100; and a rotary detent rod 433 elastically supported by the rotary detent elastic means 435 to maintain a continuous contact with the rotary detent 431.

In the multi-operating switch device for a vehicle, the rotary detent rod 433 may include: a detent rod head 4331 configured to maintain a continuous contact with the rotary detent 431; and a detent rod body 4333 connected to the detent rod head 4331 and having a length enough to allow the rotary detent elastic means 435 to be fit therearound.

In the multi-operating switch device for a vehicle, the rotary detent 431 may include a curved profile.

In the multi-operating switch device for a vehicle, the rotary detent 431 may include: a detent stable portion 4311 configured to allow the detent rod head 4331 to be seated thereon when an external force is not applied to the switch shaft unit; and a detent inclined portion 4313 connected to the detent stable portion 4311, the detent inclined portion being configured to allow the detent rod head 4331 to be brought into close contact therewith when an external force is applied to the switch shaft unit and guide the detent rod head 4331 to the detent stable portion 4311 when the external force applied to the switch shaft unit is removed.

In the multi-operating switch device for a vehicle, the push switch unit may include: a push holder 610 at least partially disposed below the substrate and configured to be brought into close contact with the switch shaft hinge of the switch shaft unit so that when the switch shaft unit is vertically moved, the push holder is vertically moved together with the switch shaft unit; a push switch 620 disposed on the underside of the substrate and configured to generate a signal indicating a change in position of the push holder when the push holder is changed in position in a vertical direction; and a push return part 630 disposed below the push holder and configured to elastically support the push holder.

In the multi-operating switch device for a vehicle, the push operation stroke of the push switch 620 may be larger than the operating stroke of the rotary switch sensor 420.

In the multi-operating switch device for a vehicle, the directional switch unit 500 may include: a directional slide part 510 configured to be changed in position within the housing unit 100 by the tilting directional operation of the switch shaft unit 300; a directional switch 560 disposed on the substrate 200, and configured to be operated by a change in the position of the directional slide part 510 to generate a signal indicating the change in the position of the directional slide part; and a directional return part 550 configured to return the directional slide part 510 and the switch shaft unit 300 to their original positions.

In the multi-operating switch device for a vehicle, the directional return part 550 may include: a return plunger 555 movably disposed in the housing unit 100; a return elastic part 553 received in the housing unit and configured to elastically support the return plunger; and a return groove 557 configured to form a continuous contact with the return plunger and including a position for returning the return plunger to its original position. The return plunger 555 may be movable in an axial direction of the switch shaft unit 300 with respect to the housing unit, and the return groove 557 may be formed in the directional slide part 510.

In the multi-operating switch device for a vehicle, the housing unit 100 may include; a housing base 130 configured to support the substrate 200; and a housing cover 110 engaged with the housing base 130 to define an inner space therebetween, and including a return mounting part 551 formed thereon to allow the return plunger 555 to be movably disposed at the return mounting part.

In the multi-operating switch device for a vehicle, the direction slide part 510 may include: a directional medium slide 530 disposed between the housing base 130 and the housing cover 110 in such a manner that the switch shaft unit 300 penetrates through the direction medium slide; a directional bottom slide 540 disposed between the directional medium slide 530 and the housing base 130 in such a manner as to penetratingly fit around the outer periphery of the switch shaft unit 300; and a directional top slide 520 formed on one surface of the housing cover 110 so as to be oriented toward the directional medium slide and configured to be engaged with the directional medium slide in a relatively movable manner.

In the multi-operating switch device for a vehicle, the directional medium slide 530 may include: a medium upper guide formed on one surface thereof so as to be engageable with the direction top slide 520; and a medium lower guide formed on the other surface thereof so as to be engageable with a bottom guide formed on the directional bottom slide 540 in a relatively movable manner.

In the multi-operating switch device for a vehicle, the directional bottom slide 540 may include: a bottom slide body 544 including the bottom guide formed on one surface thereof, and having a bottom through-hole 542 formed at the center thereof to allow the switch shaft unit 300 to penetrate therethrough in such a manner that the bottom through-hole is in close contact at the inner peripheral surface thereof with the switch shaft unit 300; a bottom slide side 547 formed extending outwardly from a side of the bottom slide body 544 and having the return groove 557 formed thereon; and a bottom slide moving part 545 formed below the bottom slide body 544 and configured to move the directional switch.

In the multi-operating switch device for a vehicle, the medium upper guide 531 and the medium lower guide 537 may be arranged so as to cross each other at 90 degree angles on the same plane when viewed from the top by projection.

In the multi-operating switch device for a vehicle, the bottom slide side 547 may be disposed at each vertex end of the bottom slide body 544, and a return dummy groove **557*d* may be formed at at least one of a plurality of the bottom slide sides 547 so as to restrict an insertion of the return plunger 555 into the return groove 557**.

In the multi-operating switch device for a vehicle, the number of the bottom slide sides 547 disposed may be four, and the return dummy groove **557*d*** may be arranged diagonally.

In yet another aspect, the present invention provides a multi-operating switch device for a vehicle, including: a housing unit; a substrate disposed within the housing unit; a switch shaft unit movably disposed so as to be received at one end thereof in the housing unit and exposed at the other end thereof to the outside of the housing unit; a rotary switch unit configured to detect the axial rotation of the switch shaft unit and output a signal indicating the detection of the axial rotation; a directional switch unit configured to detect a tilting directional operation of the switch shaft unit and output a signal indicating detection of the tilting directional operation; and a push switch unit configured to detect a pressure type push operation of the switch shaft unit and output a signal indicating the detection of the pressure type push operation, wherein the switch shaft unit 300 includes: a switch shaft hinge 320 disposed at one end thereof so as to be hingeably received within the housing unit and including a shaft hinge guide 321 formed on the outer periphery thereof; and a switch shaft body 310 of a predetermined length connected to the switch shaft hinge 320 and configured to be exposed at one end thereof to the outside from the housing unit, wherein the rotary switch unit 400 includes: a rotary block 410 disposed between the substrate 200 and the housing unit 100 and configured to at least partially receive the switch shaft hinge 320, the rotary block including a rotary block receiving guide 413 formed on the inner periphery thereof so as to be engageable with the shaft hinge guide 321 and a plurality of rotary block moving parts 415 circumferentially formed on an end thereof, which is oriented toward the substrate; and a rotary switch sensor 420 disposed on the underside of the substrate 200 so as to be brought into direct contact with the rotary block moving part 415 of the rotary block 410 and configured to be moved by a stepped portion of the rotary block moving part 415 when the rotary block 410 is axially rotated together with the switch shaft unit 300, wherein the directional switch unit 500 includes: a directional slide part 510 configured to be changed in position within the housing unit 100 by the tilting directional operation of the switch shaft unit 300; a directional switch 560 disposed on the substrate 200, and configured to be operated by a change in the position of the directional slide part 510 to generate a signal indicating the change in the position of the directional slide part; and a directional return part 550 configured to return the directional slide part 510 and the switch shaft unit 300 to their original position, wherein the directional return part 550 includes: a return plunger 555 movably disposed in the housing unit 100; a return elastic part 553 received in the housing unit and configured to elastically support the return plunger; and a return groove 557 configured to form a continuous contact with the return plunger and including a position for returning the return plunger to its original position, and wherein the return plunger 555 is movable in an axial direction of the switch shaft unit 300 with respect to the housing unit, and the return groove 557 is formed in the directional slide part 510, wherein the housing unit 100 includes; a housing base 130 configured to support the substrate 200; and a housing cover 110 engaged with the housing base 130 to define an inner space therebetween, and including a return mounting part 551 formed thereon to allow the return plunger 555 to be movably disposed at the return mounting part, wherein the direction slide part 510 includes: a directional medium slide 530 disposed between the housing base 130 and the housing cover 110 in such a manner that the switch shaft unit 300 penetrates through the direction medium slide; a directional bottom slide 540 disposed between the directional medium slide 530 and the housing base 130 in such a manner as to penetratingly fit around the outer periphery of the switch shaft unit 300; and a directional top slide 520 formed on one surface of the housing cover 110 so as to be oriented toward the directional medium slide and configured to be engaged with the directional medium slide in a relatively movable manner, wherein the directional medium slide 530 includes: a medium upper guide 531 formed on one surface thereof so as to be engageable with the direction top slide 520; and a medium lower guide 537 formed on the other surface thereof so as to be engageable with a bottom guide 541 formed on the directional bottom slide 540 in a relatively movable manner, wherein the directional bottom slide 540 includes: a bottom slide body 544 including the bottom guide formed on one surface thereof, and having a bottom through-hole 542 formed at the center thereof to allow the switch shaft unit 300 to penetrate therethrough in such a manner that the bottom through-hole is in close contact at the inner peripheral surface thereof with the switch shaft unit 300; a bottom slide side 547 formed extending outwardly from a side of the bottom slide body 544 and having the return groove 557 formed thereon; and a bottom slide moving part 545 formed below the bottom slide body 544 and configured to move the directional switch, and wherein a bottom slide side contact part 547*b* contacting with the substrate 200 is disposed below the bottom slide side 547, and a slide side guide 700 contacting with the bottom slide side contact part 547*b* is disposed at the substrate 200.

In the multi-operating switch device for a vehicle, the slide side guide 700 may include regions having differential heights from one surface of the substrate 200 depending on the contact orientation of the bottom slide side contact part 547*b*.

In the multi-operating switch device for a vehicle, the slide side guide 700 may include: a slide side guide hub part 710 configured to allow the bottom slide side contact part 547*b* to be brought into close contact therewith when no external force is applied to the switch shaft unit 300; one or more slide side guide forward parts 720 formed extending radially outwardly from the outer periphery of the slide side guide hub part 710 and having surfaces that are flush with each other; and one or more slide side guide diagonal parts 730, each of which has a pair of stepped portions with heights different from those of the slide side guide forward parts 720 between two adjacent ones of the slide side guide forward parts 720.

In the multi-operating switch device for a vehicle, the slide side guide 700 may include a slide side guide inclined part 740 inclindedly disposed between each of the slide side guide forward parts 720 and each of the slide side guide diagonal parts 730.

In the multi-operating switch device for a vehicle, the slide side guide forward part 720 may be disposed in a direction parallel to a segment disposed opposite to the directional switch 560.

In the multi-operating switch device for a vehicle, the rotary switch unit 400 may further include a rotary detent part 430 configured to detent the rotation of the rotary block 410.

In the multi-operating switch device for a vehicle, the rotary detent part 430 may include: a rotary detent 431 disposed on the underside of the rotary block; a rotary detent elastic means 435 received in a rotary detent receiving part 131 disposed in the housing unit 100; and a rotary detent rod 433 elastically supported by the rotary detent elastic means 435 to maintain a continuous contact with the rotary detent 431.

In the multi-operating switch device for a vehicle, the rotary detent rod 433 may include: a detent rod head 4331 configured to maintain a continuous contact with the rotary detent 431; and a detent rod body 4333 connected to the detent rod head 4331 and having a length enough to allow the rotary detent elastic means 435 to be fit therearound.

In the multi-operating switch device for a vehicle, the rotary detent 431 may include a curved profile.

In the multi-operating switch device for a vehicle, the rotary detent 431 may include: a detent stable portion 4311 configured to allow the detent rod head 4331 to be seated thereon when an external force is not applied to the switch shaft unit; and a detent inclined portion 4313 connected to the detent stable portion 4311, the detent inclined portion being configured to allow the detent rod head 4331 to be brought into close contact therewith when an external force is applied to the switch shaft unit and guide the detent rod head 4331 to the detent stable portion 4311 when the external force applied to the switch shaft unit is removed.

In the multi-operating switch device for a vehicle, the push switch unit may include: a push holder 610 at least partially disposed below the substrate and configured to be brought into close contact with the switch shaft hinge of the switch shaft unit so that when the switch shaft unit is vertically moved, the push holder is vertically moved together with the switch shaft unit; a push switch 620 disposed on the underside of the substrate and configured to generate a signal indicating a change in position of the push holder when the push holder is changed in position in a vertical direction; and a push return part 630 disposed below the push holder and configured to elastically support the push holder.

In the multi-operating switch device for a vehicle, the push operation stroke of the push switch 620 may be larger than the operating stroke of the rotary switch sensor 420.

In the multi-operating switch device for a vehicle, the medium upper guide 531 and the medium lower guide 537 may be arranged so as to cross each other at 90 degree angles on the same plane when viewed from the top by projection.

In the multi-operating switch device for a vehicle, the bottom slide side 547 may be disposed at each vertex end of the bottom slide body 544, and a return dummy groove 557*d* may be formed at at least one of a plurality of the bottom slide sides 547 so as to restrict an insertion of the return plunger 555 into the return groove 557.

In the multi-operating switch device for a vehicle, the number of the bottom slide sides 547 disposed may be four, and the return dummy groove 557*d* may be arranged diagonally.

Advantageous Effects

The multi-operating switch device for a vehicle according to the embodiments of the present invention as constructed above have the following advantageous effects.

The multi-operating switch device is mounted at a steering wheel or a console switch device of the inside of a vehicle so that a combined operation can be implemented to select or control the electrical operation of a navigation device, an audio multimedia device, and an air conditioner of the vehicle, which are used in the inside of the vehicle.

In addition, the multi-operating switch device for a vehicle of the present invention minimizes the number of constituent elements and concentrates a switch sensor and the like on a single substrate to minimize a problem associated with an electrical wiring and thus improve a degree of freedom of design and assemblability, thereby reducing the manufacturing cost due to improvement of productivity.

Moreover, the multi-operating switch device for a vehicle of the present invention can minimize a mounting space through a compact configuration or a partition of an arrangement region of various operations, and prevent or minimize the possibility of erroneous operation of the switch due to interference between the constituent elements.

Further, the multi-operating switch device for a vehicle of the present invention can minimize an angle at which the switch shaft body can rotate about the switch shaft hinge for operation of the directional switch unit to prevent occurrence of an interference due to a contact with the knob and the housing unit to minimize the spaced distance between the knob and the housing unit and thus prevent foreign substances from being introduced into the directional switch unit through the through-hole of the housing cover or the like, through a structure in which the switch shaft hinge is disposed below the directional slide part, i.e., the switch shaft hinge is disposed at a lower portion of the housing unit and the directional slide part and the directional switch are disposed at a position higher than the rotary switch unit and the push switch unit. In addition, the possibility of interference between the knob and the housing unit can be prevented or decreased so that the constituent elements can be designed in a compact manner.

Furthermore, the multi-operating switch device for a vehicle of the present invention can implement the push operation through the rotary detent part so that the number of parts and the manufacturing cost can be reduced and a compact configuration can be implemented.

Besides, the multi-operating switch device for a vehicle of the present invention operates the directional switch through a rotation type structure so that a stroke space required in a movable operation process can be minimized to a mounting space, and a compact configuration can be implemented to prevent or minimize the possibility of erroneous operation of the switch due to interference between the constituent elements.

In addition, the multi-operating switch device for a vehicle of the present invention can maximize an operating stroke of the push switch unit to enhance a degree of freedom of design and minimize the possibility of erroneous operation of the switch or damage of parts.

Moreover, the multi-operating switch device for a vehicle of the present invention can prevent the possibility of erroneous assembly through the return dummy groove and reduce the manufacturing cost.

The multi-operating switch device for a vehicle of the present invention can nearly uniformize an omni-directional operating stroke of the switch shaft unit, which operates the directional switch unit to prevent formation of a feeling of heterogeneity of the manipulation of the switch by a user.

BRIEF DESCRIPTION OF THE DRAWINGS

The above and other objects, features and advantages of the present invention will be apparent from the following detailed description of the preferred embodiments of the invention in conjunction with the accompanying drawings, in which.

BEST MODE FOR CARRYING OUT THE INVENTION

Figure 1:
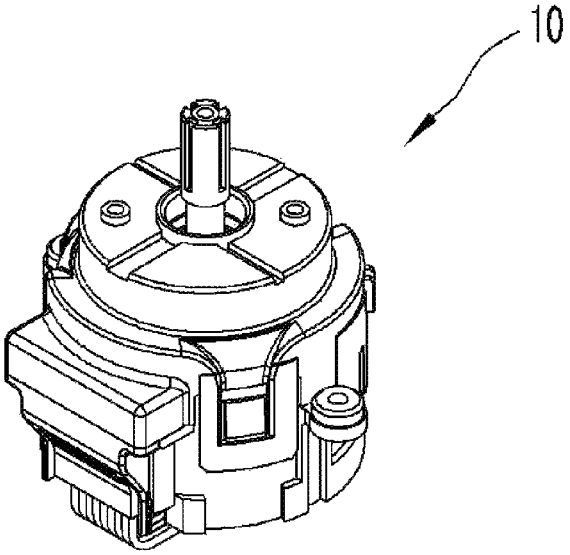
FIG. 1 is a schematic perspective view illustrating a multi-operating switch device for a vehicle according to one embodiment of the present invention.
Figure 2:
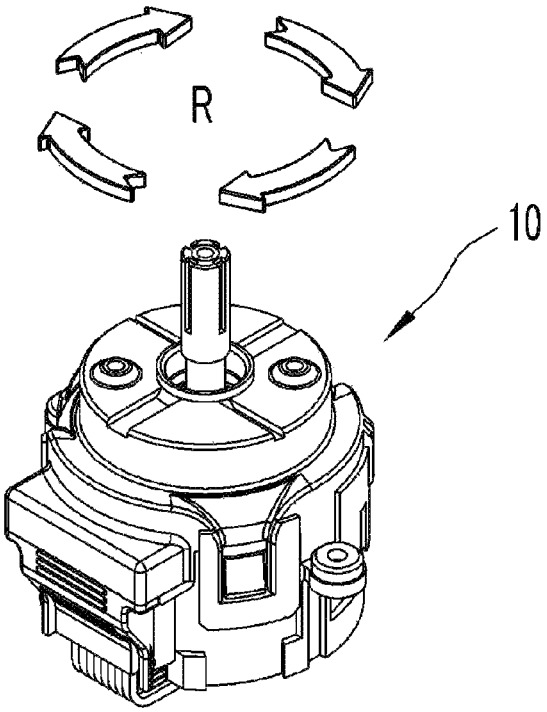
FIG. 2 is a schematic perspective view illustrating the rotary operation state of a multi-operating switch device for a vehicle according to one embodiment of the present invention.
Figure 3:
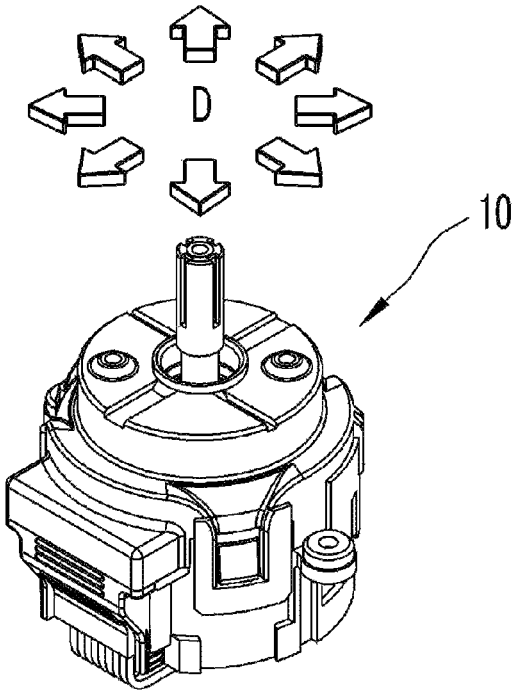
FIG. 3 is a schematic perspective view illustrating the directional tilting operation state of a multi-operating switch device for a vehicle according to one embodiment of the present invention.
Figure 4:
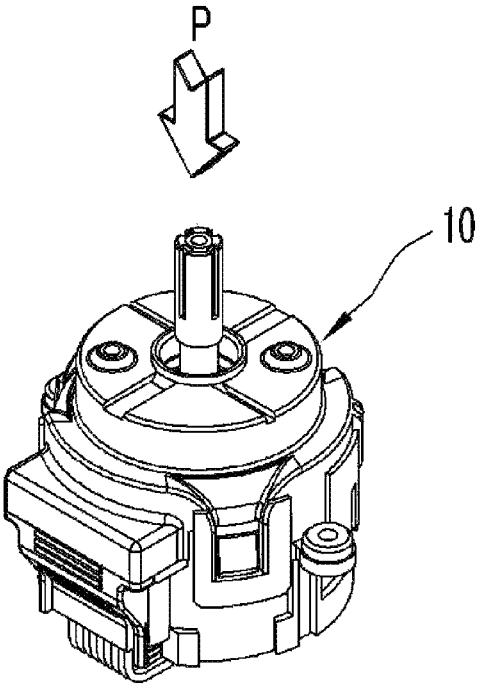
FIG. 4 is a schematic perspective view illustrating the push operation state of a multi-operating switch device for a vehicle according to one embodiment of the present invention.

Now, preferred embodiments of the present invention will be described hereinafter in detail with reference to the accompanying drawings. It should be noted that the same elements in the drawings are denoted by the same reference numerals although shown in different figures. In the following description, the detailed description on known function and constructions unnecessarily obscuring the subject matter of the present invention will be avoided hereinafter.

A multi-operating switch device 10 for a vehicle in accordance with the present invention includes a housing unit 100, a substrate 200, a switch shaft unit 300, a rotary switch unit 400, a directional switch unit 500, and a push switch unit 600. The multi-operating switch device 10 for a vehicle in accordance with the present invention is a switch device that is used in a vehicle. The switch device enables the implementation of various manipulation states thereof so that it is used to control various functions of the vehicle, for example, the operation states of a wide range of electrical and electronic devices for a vehicle such as an audio device, a navigator, an air-conditioner.

The housing unit 100 includes a housing cover 110 and a housing base 130. The housing cover 110 and the housing base 130 are engaged with each other to define an inner space therebetween. The housing base 130 forms a structure that supports the substrate 200, and the housing cover 110 is engaged with the housing base 130 to define the inner space therebetween (claim 1). The housing cover 110 includes a through-hole 111 formed on one surface thereof to allow one end of the switch shaft unit 300 which will be described later to be exposed to the outside through the through-hole 111 so that a manipulation force of a user such as a driver can be provided.

In this embodiment, the housing unit 100 further includes a housing holder 120. The housing holder 120 is disposed between the housing cover 110 and the housing base 130. The housing holder 120 can serve to support the substrate 200 together with the housing base 130, and divides the inner space defined by the housing cover 110 and the housing base 130 so that a space dividing function can be performed which prevents an interference from occurring upon the operation of the rotary switch unit 400 and the directional switch unit 500, which will be described later.

The substrate 200 is disposed within the housing unit 100 (claim 1). Various electric elements can be disposed on the substrate 200. The electric elements may be electrically connected to each other through a wiring formed on the substrate 200. Alternatively, the electric elements may have a structure that establishes an electrical communication by means of other elements, for example, a flexible substrate and a cable. In this embodiment, the substrate 200 is implemented as a double-sided substrate so that various elements can be disposed on both sides thereof.

The substrate 200 has a through-hole 202 formed at the center thereof so that the switch shaft unit 300 can be disposed penetratingly in the substrate through the through-hole 202. The substrate 200 is formed at one end thereof with a substrate connector 201. A connector 203 is connected to the substrate connector 201 so that the substrate 200 can be electrically connected to an external electrical device such as, for example, a control unit (not shown) through the connector 203.

The switch shaft unit 300 has a structure in which it is received at one end thereof in the housing unit 100 and is exposed at the other end thereof to the outside of the housing unit. The switch shaft unit 300 includes a switch shaft body 310 and a switch shaft hinge 320. The switch shaft body 310 is implemented as a rod type member having a predetermined length, and the switch shaft hinge 320 is disposed at one end of the switch shaft body 310 so as to be received within the housing unit 100. Although not shown in this embodiment, a switch knob (not shown) is mounted at an end of the switch shaft body 310, which is exposed to the outside to make a grip of a driver smooth so that a certain sense of manipulation can be provided to the driver.

The switch shaft hinge 320 connected to a lower end of the switch shaft body 310 has a spherical shape in this embodiment, and may have a modified shape depending on a detailed design specification. The switch shaft hinge 320 forms a rotation center of the switch shaft unit 300. The switch shaft hinge 320 is disposed in a space defined by the housing holder 120 and a rotary encoder receiving part 411 (see FIG. 5) formed in a rotary encoder 410 of the rotary switch unit 400 which will be described later. The switch shaft hinge 320 has a structure in which the switch shaft body 310 is disposed penetratingly through a through-hole 121 formed on the housing holder 120.

Thus, the switch shaft body 310 can implement a combined operation of an axial rotation thereof, a tilting movement thereof about the switch shaft hinge 320 by application of a horizontal pressing force, and a press and push movement thereof in which the switch shaft body 310 is pressed downwardly.

The switch shaft hinge 320 functioning as a rotation center point for the directional tilting movement of the switch shaft body 310 according to this embodiment is positioned between the housing unit and the substrate, specifically between the substrate 200 and the housing base 130, more specifically between the housing holder 120 disposed below the substrate 200 and the housing base 130. The directional switch unit 500 has a structure in which it is disposed between the substrate 200 and the housing cover 110 so as to be spaced apart from the switch shaft hinge 320 serving as the rotation center of the switch shaft body 310 so that the directional tilting movement of the switch shaft body 310 required to move a directional switch 560 of the directional switch unit 500 disposed above the switch shaft hinge 320 can be minimized to minimize the spaced distance between the directional switch unit 500 and the housing cover, thereby preventing foreign substances from being introduced into the directional switch unit 500 through the housing cover.

Figure 17:
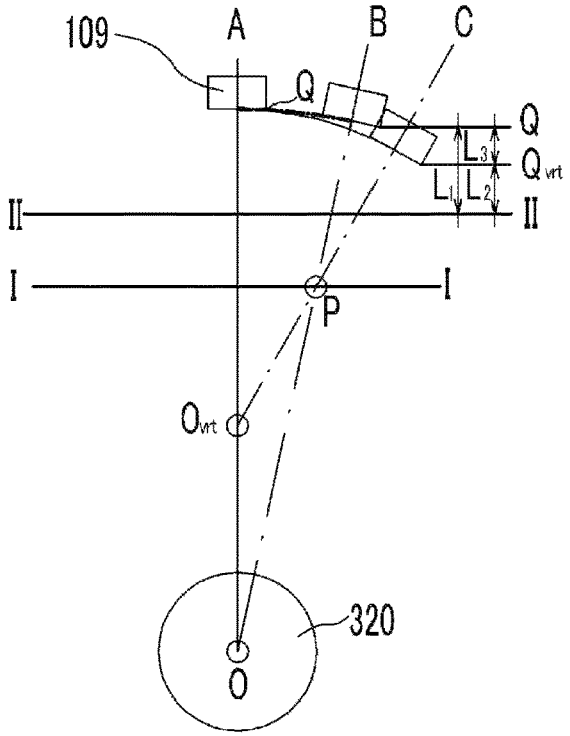
FIG. 17 is a state view illustrating the directional tilting operation process of a multi-operating switch device for a vehicle according to one embodiment of the present invention.

In other words, FIG. 17 illustrates the state view of the switch shaft body 310 and the switch shaft hinge 320 that implement the directional tilting operation. In FIG. 17, a knob 109 is disposed at an end of the switch shaft body 310. In a normal state, the switch shaft body is disposed on a line O-A. When it is assumed that a position for moving the directional switch 560 into the directional tilting operation state of the switch shaft body of the present invention is a point P on a line I-I, the length of the switch shaft body 310 until the switch shaft body 310 reaches the position P exists on a line O-B. At this point, the end of the knob 109 occupies a position indicated by a reference symbol Q.

On the contrary, unlike the structure of the present invention, if the switch shaft hinge occupies a virtual center point Ovrt, the switch shaft body is positioned on a line Ovrt-C until the switch shaft body is moved to the point P required to move the directional switch. In this case, the end of the knob 109 occupies the position of Qvrt. When it is assumed that a line II-II is a predetermined reference line, the distances between the ends Q and Qvrt of the knob 109 for each case and the line II-II are indicated by L1 and L2, and the following relationship is satisfied: L1>L2 (L1−L2=L3>0).

In other words, the lower arrangement structure of the switch shaft hinge minimizes the directional tilting angle required to move the directional switch 560 to minimize the movement distance of the knob 109 toward the housing unit and thus minimize the spaced distance between the knob 109 and the housing cover of the housing unit so that a possibility of introduction of foreign substances into the direction switch unit through the housing cover can be reduced and a compact structure can be implemented.

The rotary switch unit 400 detects the axial rotation of the switch shaft unit 300 and outputs a signal indicating the detection of the axial rotation for application to an external device such as a control unit (not shown). The rotary switch unit 400 includes a rotary encoder 410 and a rotary switch sensor 420. The rotary encoder 410 is disposed between the substrate 200 and the housing base 130 of the housing unit 100, and has a structure in which it at least partially receives the switch shaft hinge 320 of the switch shaft unit 300. In other words, the rotary encoder 410 includes a rotary encoder receiving part 411. The rotary encoder receiving part 411 is a space formed at the center of the rotary encoder 410 and defines a mounting space together with the housing holder 120 disposed above the rotary encoder 410 to allow the switch shaft hinge 320 to be seated therein.

The rotary encoder 410 includes a rotary encoder receiving guide 413 formed on the inner periphery thereof to partition the rotary encoder receiving part 411 inside the rotary encoder 5410. The switch shaft hinge 320 of the switch shaft unit 300 includes a shaft hinge guide 321 formed on the outer periphery thereof so that the shaft hinge guide 321 is receivingly disposed in the rotary encoder receiving guide 413.

The rotary encoder receiving guide 413 and the shaft hinge guide 321 have a structure in which they are engaged with each other to prevent a relative axial rotation thereof. In this embodiment, the rotary encoder receiving guide 413 and the shaft hinge guide 321 have a structure in which a predetermined relative movement thereof along the axial direction thereof, i.e., an axial longitudinal direction of the switch shaft body 310 is permitted. In other words, the rotary encoder receiving guide 413 has a rectangular structure in an axial longitudinal direction in a state in which an external force is not applied to the switch shaft body 310 so that an axial longitudinal direction length of a rotary shaft of the rotary encoder 410 is larger than a circumferential direction length of the rotary encoder 410. When it is assumed that the circumferential direction length of the rotary encoder 410 of the rotary encoder receiving guide 413 is a horizontal length A and the axial longitudinal direction length of the rotary shaft of the rotary encoder 410 is a longitudinal length B, the aspect ratio (AR=B/A) is set to have a value larger than 1.

The rotary encoder 410 has a plurality of rotary encoder slits 415 formed on the outer periphery thereof. The rotary switch unit 400 includes a rotary switch sensor 420 disposed at a position corresponding to the rotary encoder slits 415. In other words, the rotary switch sensor 420 is implemented as an optical sensor and is disposed on an underside of the substrate 200. The rotary encoder slits 415 at the end of the rotary encoder 410 are movably disposed at a position corresponding to the rotary switch sensor 420 so that the rotary switch sensor 420 can detect the rotation state of the rotary encoder 410 performing the axial rotation together with the switch shaft unit 300 based on the number of movements of the rotary encoder slits 415, and transmits a signal indicating the detection of the rotation state of the rotary encoder 410 to the external device via the substrate 200.

The rotary switch unit 400 may include an constituent element for detenting the rotation of the switch shaft unit 300 and the rotary encoder 410 so as to prevent an undesirable rotation of the rotary switch unit 400 as well as an erroneous operation in setting the operation states of devices of a vehicle through the rotation operation of the switch shaft unit by generating a more accurate rotation signal. That is, the rotary switch unit 400 of the present invention includes a rotary dent unit 430. The rotary detent part 430 includes a rotary detent 431, a rotary detent ball 433, and a rotary detent elastic means 435. The housing base 130 of the housing unit 100 includes a rotary detent receiving part 131 formed therein. The rotary detent elastic means 435 is receivingly disposed at the rotary detent receiving part 131.

The rotary detent 431 is disposed on the underside of the rotary encoder 410. The rotary detent 431 may be formed as a separate element and then mounted on the underside of the rotary encoder 410, it has a structure which is formed integrally on the underside of the rotary encoder 410 in this embodiment. The rotary detent 431 is implemented as a plurality of prominences and a plurality of depressions which are alternately arranged with each other in this embodiment, and may have a structure in which the prominences and the depressions are arranged spaced apart from each other at predetermined intervals, respectively. Although not shown in this embodiment, the rotary switch unit 400 may have a structure in which it further includes a rotary stopper (not shown) for preventing the excessive rotation of the rotary encoder to form a rotation restriction region, if necessary. In addition, the rotary switch unit 400 may be modified in various manners, such as having a structure of performing infinite rotation without restriction of rotation and initializing a rotation reference upon the turning off of the power switch.

The rotary detent receiving part 131 is formed at a position corresponding to the rotary detent 431, and the rotary detent elastic means 435 of a coil spring structure is disposed at the rotary detent receiving part 131. The rotary detent elastic means 435 elastically supports the rotary detent ball 433 to maintain a continuous contact with the rotary detent 431. Although the rotary detent elastic means has been implemented as a coil spring in this embodiment, it may be implemented as a spiral-type leaf spring and may be modified in various manners within a range of implementing a rotary detenting operation, such as performing a detenting operation through the contact between the a punched protrusion of the leaf spring and the rotary detent.

Meanwhile, in the case where a force is applied to the switch shaft body 310 of the switch shaft unit 300 to cause the switch shaft body 310 to be laterally moved relative to the switch shaft hinge 320 to perform a direction operation of the switch shat unit 300, the directional switch unit 500 detects a movement of the switch shaft body 310 to one direction on a plane parallel with the substrate 200 when it is viewed from the plane parallel with the substrate 200 due to the tilting operation of the switch shaft unit 300, and output a signal indicating the detection of the movement of the switch shaft body 310.

The directional switch unit 500 includes a directional slide part 510, a directional switch 560, and a directional return part 550. The directional slide part 510 can be changed in position within the housing unit 100 by the tilting directional operation of the switch shaft unit 300. The directional slide part 510 performs a movement operation on a plane parallel with the substrate so that the directional tilting movement of the directional switch unit 500 can be performed in which the tilting movement of the switch shaft unit can be converted into a planar movement of the directional switch unit 500 on the plane parallel with the substrate.

The directional switch 560 is disposed on the substrate 200, and is operated by a change in the position of the directional slide part 510 to generate a signal indicating the change in the position of the directional slide part 510. In this embodiment, the directional switch 560 is implemented as a contact switch, but may be modified in various manners depending on a design specification.

The directional switch 560 is disposed on a top surface of the substrate 200 so as to be oriented toward the housing cover 110. The directional switch 560 takes a structure in which it is movably disposed at an upper portion of the housing holder 120, which is divided relative to the housing holder 120.

Meanwhile, the directional slide part 510 in accordance with the present invention includes a directional top slide 520, a directional medium slide 530, and a directional bottom slide 540 (claim 6). The directional medium slide 530 is disposed between the housing base 130 and the housing cover 110, more specifically, between the housing cover 110 and the housing holder 120. The directional medium slide 530 has a medium through-hole 533 formed at the center thereof to allow the switch shaft body 310 of the switch shaft unit 300 to penetrate therethrough.

In addition, the directional medium slide 530 has a medium side 535 formed at a side thereof. The medium side 535 has a groove formed at a side of the directional medium slide 530 so that an interference with an element of the directional return part which will be described later can be excluded.

Figure 13:
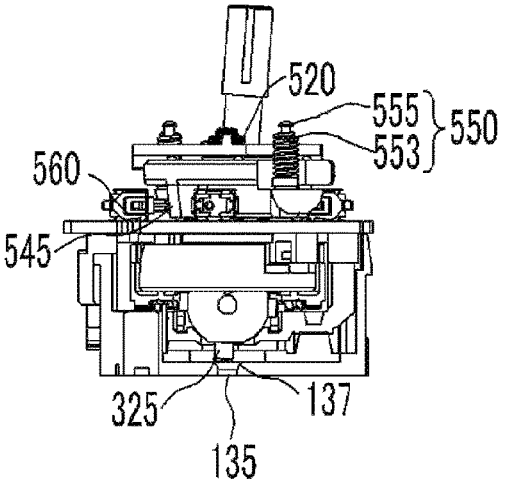
FIG. 13 is a schematic partial side view illustrating the directional tilting operation state of a multi-operating switch device for a vehicle according to one embodiment of the present invention.
Figure 14:
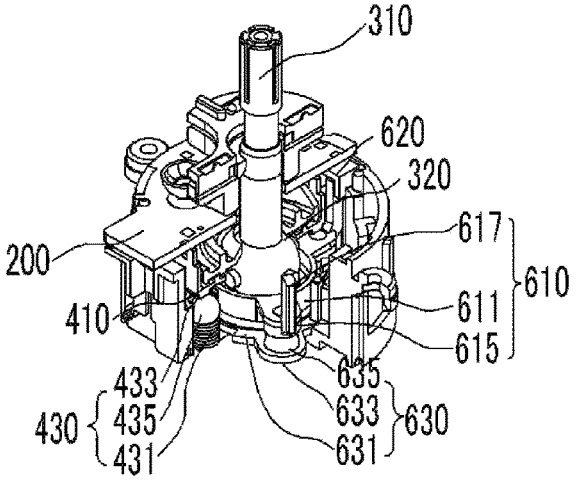
FIG. 14 is a schematic partial cut-away perspective view illustrating a multi-operating switch device for a vehicle according to one embodiment of the present invention.
Figure 15:
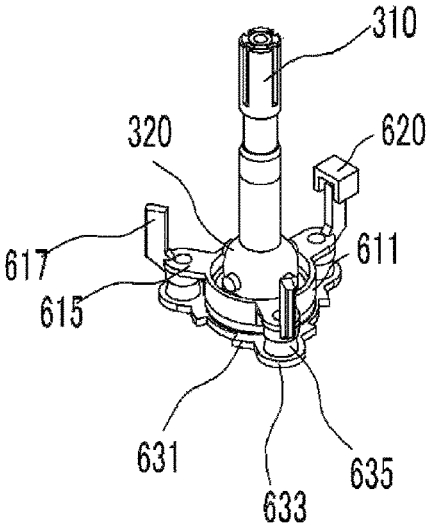
FIG. 15 is a schematic partial perspective view illustrating a push switch unit of a multi-operating switch device for a vehicle according to one embodiment of the present invention.

The directional medium slide 530 has a predetermined plate structure, and includes a medium upper guide 531 and a medium lower guide 537. The medium upper guide 531 is formed on one surface of the directional medium slide 530 so as to be oriented toward the housing cover 110. The medium lower guide 537 is formed on the other surface of the directional medium slide 530 so as to be oriented toward the housing holder 120. The directional top slide 520 (see a dotted line indicated in FIG. 13) is formed on one surface of the housing cover 110 so as to be oriented toward the directional medium slide 530 and is engaged with the directional medium slide 530 in a relatively movable manner. The directional top slide 520 is engaged with the medium upper guide 531 of the directional medium slide 530 to form a relatively movable structure so that the directional medium slide 530 can be moved on a horizontal plane in the lengthwise direction of the medium upper guide 531 and the directional top slide 520 within the housing unit 100.

In this embodiment, the directional top slide 520 is formed in a recessed shape and the medium upper guide 531 is formed in a projected shape. The directional top slide 520 and the medium upper guide 531 may be modified in various manners, such as taking a configuration in which they are formed in terms of the recessed and projected shapes thereof.

Further, the directional medium slide 530 has the medium lower guide 537 formed on the other surface, i.e., the underside thereof. The medium lower guide 537 is engaged with a bottom guide 541 formed on the directional bottom slide 540 in a relatively movable manner. In this embodiment, the medium lower guide 537 is formed as a projected structure and the bottom guide 541 is formed as a recessed structure, but vice-versa.

The directional bottom slide 540 includes a bottom slide body 544, a bottom slide side 547, and a bottom slide moving part 545. The bottom slide body 544 includes the bottom guide 541 formed on one surface thereof, and has a bottom through-hole 542 formed at the center thereof. The bottom through-hole 542 has a structure in which it forms a cocentrical structure together with the medium through-hole 533, but the inner diameter of the bottom through-hole 542 is smaller than that of the medium through-hole 533. The inner diameter of the bottom through-hole 542 has a value that is approximate to the outer diameter of the switch shaft body 310 so that the inner peripheral surface of the bottom through-hole 542 comes into close contact with the outer peripheral surface of the switch shaft body 310, and thus the directional bottom slide 540 can perform the directional tilting operation in which the directional bottom slide 540 is moved on a horizontal plane upon the tilting movement of the switch shaft unit 300.

The bottom slide body 544 may have a bottom slide lug 543 formed on one surface thereof to form a point-contact structure which minimizes a contact area with the directional medium slide 530 disposed on the top surface thereof to reduce a contact resistance. Although the directional bottom side takes a structure in which a projected structure is formed at the bottom slide body in this embodiment, various modifications can be possible such as taking a structure in which the projected structure is formed at the directional medium slide.

The bottom slide side 547 has a structure in which it is formed extending outwardly from a side of the bottom slide body 544. The bottom slide side 547 may a structure in which it is formed separately from the bottom slide body 544 so as to be engaged with the bottom slide body, if necessary. The bottom slide side 547 is formed at a position corresponding to the medium side 535. The return groove 557 which will be described later is formed in the bottom slide side 547.

Figure 16:
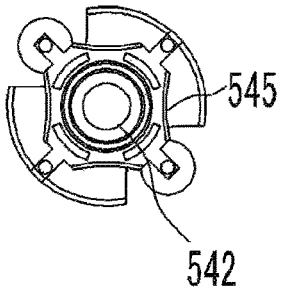
FIG. 16 is a bottom view illustrating a directional bottom slide of a multi-operating switch device for a vehicle according to one embodiment of the present invention.

The bottom slide moving part 545 is formed below the bottom slide body 544. In the case where the directional bottom slide 540 performs the directional tilting operation, the bottom slide moving part 545 can move directional switches 560 equidistantly arranged radially on the substrate 200 so as to be positioned adjacent to the bottom through-hole 542. In this embodiment, the directional switches 560 are implemented as contact switches. The bottom slide moving part 545 is forms a projected structure that enables a contact with the directional switches 560. In this embodiment, the number of the directional switches 560 provided is four. The bottom slide moving part 545 is formed as a projected square structure having four movable faces correspondingly to the directional switches 560 so that respective allocated movable faces of the bottom slide moving part 545 forms a contact with the directional switches 560 to generate a signal indicating the change in the position of the directional switches 560. More specifically, as shown in FIG. 16, the bottom slide moving part 545 is formed on the underside of the directional bottom slide 540. The bottom slide moving part 545 is formed as a projected square structure, but may be formed as a structure having a predetermined inwardly arcuate shape so as to perform a smooth operation upon the contact between the bottom slide moving part 545 and the directional switches 560 and prevent durability of the directional switches from being degraded through a stable contact and separation operation upon the directional operation.

In the meantime, although it has been described in this embodiment that the directional switch is pressed radially from the center of the switch shaft unit in a horizontal movement manner, the directional switch of the multi-operating switch device for a vehicle of the present invention is not limited to the pressing operation in a radial direction. In other words, the directional bottom slide performs a horizontal movement operation in the radial direction, but the directional switch is certainly not limited to a configuration of performing the horizontal movement operation.

In FIGS. 24 to 27, there is shown another example of a directional switch of the present invention. In order to facilitate the understanding of the present invention, reference numerals and relevant elements are maintained to be the same. A directional switch 560 includes a directional switch housing 561 and a directional switch knob 563. Directional switch contact parts 565 and 567 disposed within the directional switch housing 561 are moved through the directional switch knob 563.

The directional switch housing 561 is disposed on one surface of the substrate 200, and the directional switches 560 preferably have a structure in which they are equidistantly arranged radially around the center of the switch shaft unit 300.

The directional switch housing 561 includes a directional switch housing cover 5611 and a directional switch housing body 5613. The directional switch housing cover 5611 and the directional switch housing body 5613 are configured such that they are engaged with each other to define an internal space therebetween so that the directional switch knob 563 and the like are at least partially disposed receivingly in the internal space.

Although it has been illustrated in this embodiment that the directional switch housing 561 includes the directional switch housing cover 5611 and the directional switch housing body 5613, it may be configured in various manners depending on a design specification, such as having a configuration in which only the directional switch housing cover is fixedly mounted on one surface of the substrate, or a configuration in which the directional switch housing body and the substrate are integrally formed with each other by injection-molding.

The directional switch housing 561 has a directional switch housing knob through-opening 5612 formed on one surface thereof so as to be oriented toward one surface of the substrate 200.

The directional switch knob 563 is disposed in the directional switch housing 561 so as to be at least partially exposed to the outside from one surface of the directional switch housing. The exposed portion of the directional switch knob 563 has a structure in which it can be in close contact with the directional slide part. The directional switch knob 563 has a structure in which it is pivotally rotated about one point at the inside of the directional switch housing 561, i.e., about an axis parallel with the substrate 200.

Figure 27:
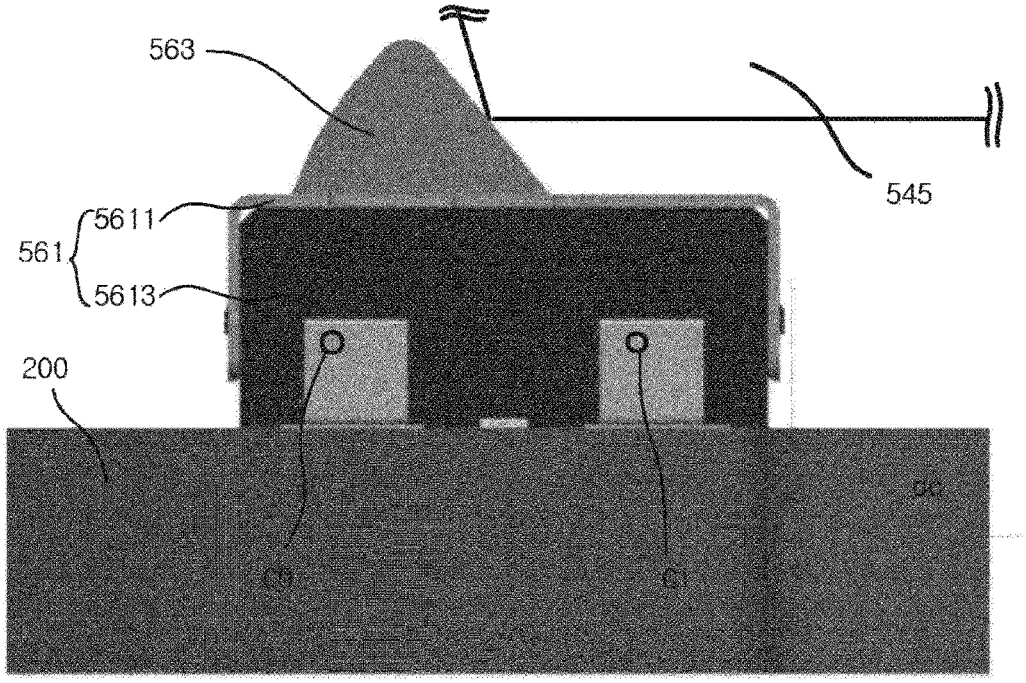
FIG. 27 is a schematic perspective view illustrating a directional switch of a multi-operating switch device for a vehicle according to still another embodiment of the present invention.

As shown in FIG. 27, the directional switch knob 563 is exposed to the outside of from one surface of the directional switch housing through the directional switch housing knob through-opening 5612 in a normal state in which no external force is applied thereto. When the bottom slide moving part 545 of the directional bottom slide 540 of the directional slide part is moved horizontally on a plane parallel with the substrate, the directional switch knob 563 is pivotally rotated about one point at the inside of the directional switch housing 561 and advances into the directional switch housing 561 through the directional switch housing knob through-opening 5612.

One point about which the directional switch knob 563 is pivotally rotated, i.e., a rotation point of the directional switch knob 563 is positioned adjacent to an end of the directional switch knob so as to be oriented toward the center of the switch shaft unit 300. More specifically, the directional switch knob 563 is disposed radially from the center of the switch shaft unit 300. In other words, the directional switch knob 563 is formed to extend in a certain longitudinal direction radially from the center of the switch shaft unit 300. The directional switch knob 563 is arranged to be perpendicular to the substrate 200 and has a structure in which it is pivotally rotated about a rotary shaft disposed horizontal to the substrate 200. The rotation center of the directional switch knob 563 is positioned adjacent to an end of the directional switch knob, but not a far away point radially in the longitudinal direction of the directional switch knob so as to be oriented toward the center of the switch shaft unit. That is, as shown in FIG. 27, the directional switch knob 563 has a structure in which it is disposed to be pivotally rotated about a point denoted by a reference numeral CI, but not a reference numeral CO. Such a radial internal point is used as a rotation center so that the progressive rotation of the directional switch knob can be performed relative to the bottom slide moving part of the directional slide part, thereby improving a degree of freedom of design of the directional switch itself.

In addition, the directional switch knob 563 includes a directional switch elastic part 564 for allowing the directional switch knob 563 to return to its original position when an external force applied to the directional switch knob 563 is removed and a directional switch contact parts 565 and 567. The directional switch elastic part 564 and a directional switch contact parts 565 and 567 can be disposed within the directional switch housing.

Figure 29:
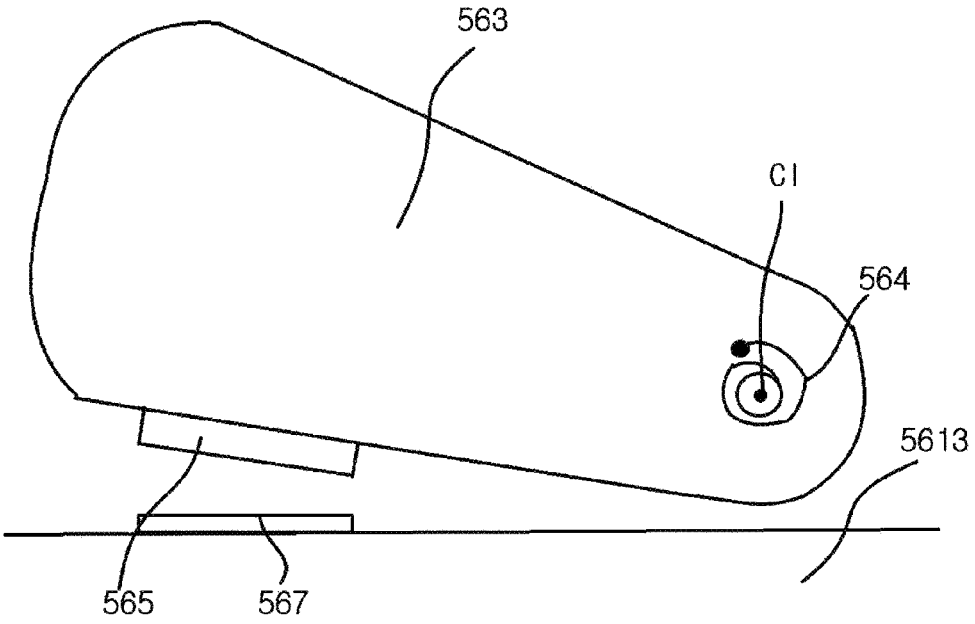
FIG. 29 is a schematic partial side view illustrating a directional switch of a multi-operating switch device for a vehicle according to still another embodiment of the present invention.

In FIG. 29, there is shown an example of the directional switch elastic part and the directional switch contact parts. In other words, the directional switch elastic part 564 serves to provide an elastic restoring force to the directional switch knob 563 in the directional switch housing 561. The directional switch elastic part 564 may have a structure in which it is directly connected to the rotation center CI of the directional switch knob 563. In other words, in this embodiment, the directional switch elastic part 564 has a structure in which it is implemented as a torsion spring to support the directional switch knob 563 by means of an initial elastic force of the directional switch knob 563 and allow the directional switch knob 563 to return to its original position by the elastic restoring force thereof when the external force exerted to the directional switch knob 563 is removed.

The directional switch contact part (565, 567) includes a directional switch movable contact 565 and a directional switch fixed contact 567. The directional switch movable contact 565 is moved by the directional switch knob 563. The directional switch movable contact 565 may have a structure in which it is disposed on the underside of the directional switch knob 563.

The directional switch fixed contact 567 is disposed so as to be contactable with the directional switch movable contact 565 when the directional switch movable contact 565 is moved by the directional switch knob 563. The directional switch fixed contact 567 may have a structure in which it is formed on the directional switch housing body 5613 and is electrically connected with an external electrical device via the substrate 200 through a modularized connector (not shown) for the directional switch. In addition, as described above, in some embodiments, in the case where the directional switch housing body and the substrate are integrally formed with each other by insert molding, the directional switch fixed contact may be integrally with the substrate.

Figure 28:
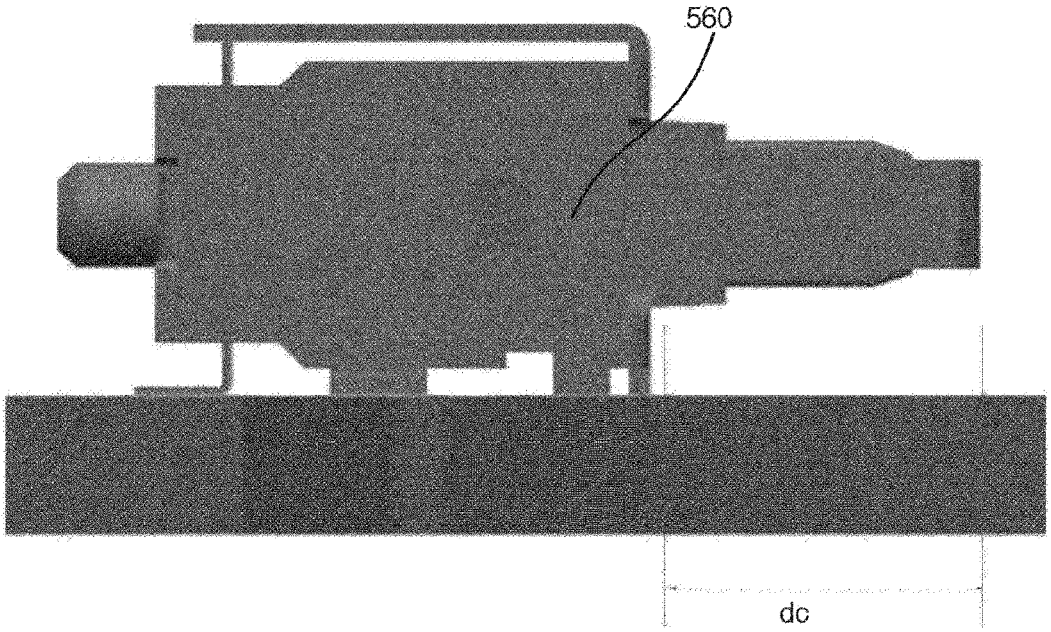
FIG. 28 is a schematic side view illustrating a directional switch which is moved in a simple radial direction according to still another embodiment of the present invention.

As such, the directional switch knob 563 has a structure in which it is exposedly disposed on one surface of the directional switch 560, which is parallel to the substrate and is moved in a rotation manner so that a movable space is considerably reduced compared to a stroke space dc (see FIGS. 27 and 28) required by a simple radial movement, thereby enabling a compact configuration of the device.

The directional tilting movement of the directional slide part 510, i.e., a horizontal sliding movement on a horizontal plane by the tilting movement of the switch shaft unit can be carried out through the relative movement of the directional top slide, the directional medium slide, and the directional bottom slide, i.e., a relative movement between the directional top slide and the medium upper guide and between the medium lower guide and the bottom guide. In this embodiment, the medium upper guide and the medium lower guide have a structure in which they are arranged so as to cross each other at 90 degree angles on the same plane when viewed from the top by projection so that the movement to any position on the horizontal plane of the directional tilting movement can be performed.

In the meantime, as described above, the directional switch unit 500 includes a directional return part 550. The directional return part 550 returns the directional slide part 510 and the switch shaft unit 300 to their original positions after an external force applied to the switch shaft unit is removed. The directional return part 550 includes a return elastic part 553, a return plunger 555, and a return groove 557. The return plunger 555 is movably disposed in the housing unit 100. In other words, the housing cover 110 of the housing unit 100 includes a return mounting part 551 formed thereon. The return plunger 555 is movably disposed at the return mounting part 551. The return plunger 555 is formed in a rod shape, and an end thereof is oriented toward the return groove 557. The return elastic part 553 is disposed in the return mounting part 551 where the return plunger 555 is disposed. The return elastic part 553 is supported at one end thereof by the inner surface of the return mounting part 551 and is in close contact at the other end thereof with the outer peripheral surface of the return plunger 555 so as to elastically support the return plunger 555 with respect to the housing cover 110.

The return groove 557 forms a continuous contact with the return plunger 555. In the case of a normal state in which the external force applied to the switch shaft unit is removed, the interaction between the return plunger 555 and the return elastic part 553 returns the return plunger 555 to its original position and thus ultimately return the directional slide part 510 to its original position. The return plunger 555 is elastically supported by the return elastic part 553 so that it can be moved in an axial direction in parallel with an axial longitudinal direction of the switch shaft body 310 of the switch shaft unit 300 in the return mounting part 551 of the housing unit 100. The return groove 557 is formed at the bottom slide side 547 of the directional bottom slide 540.

The return groove 557 includes a groove stable portion 558 and a groove moving portion 559. The groove stable portion 558 forms a contact with a lower end of the return plunger 555 in a normal state in which no external force is applied to the switch shaft body 310. The groove moving portion 559 is disposed at the outside of the groove stable portion 558 so that when an external force is applied to the switch shaft body 310 of the switch shaft unit 300 to cause the switch shaft body 310 to be moved in a transverse direction from the center thereof, the groove moving portion 559 forms a contact with the lower end of the return plunger 555.

By virtue of this simple operation of the directional return part 550, when an external force perpendicular to the lengthwise direction of the switch shaft body 310 is applied to the switch shaft body 310 and then is removed, the switch shaft body 310 can stably return to its original position.

The push switch unit 600 of the present invention detects a pressure type push operation of the switch shaft unit 300 and outputs a signal indicating the detection of the pressure type push operation. The push switch unit 600 includes a push holder 610, a push switch 620, and a push return part 630.

The push holder 610 is at least partially disposed below the rotary encoder 410 and is configured to be in close contact with the switch shaft hinge 320 of the switch shaft unit 310 so that when the switch shaft unit 300 is vertically moved, the push holder 610 is vertically moved together with the switch shaft unit 300. The push switch 620 may be implemented as an optical sensor. Although it has been described in this embodiment that the push switch 620 is implemented as the optical sensor, it may be modified in various manners, such as being implemented as a non-contact type magnetic sensor switch and magnet structure, if necessary.

When the push holder 620 is changed in position in a vertical direction, the push switch 620 generates a signal indicating the change in the position of the push switch 620. The push switch 620 is disposed on the underside of the substrate 200 so as to be positioned in proximity to the rotary switch sensor 420. The push return part 630 is disposed below the push holder 610 and elastically supports the push holder 610. When an external force applied to the push holder 610 is released, the push holder 610 returns to its original position.

More specifically, the push holder 610 includes a holder body 611, a holder extension 615, and a holder moving part 617. The holder body 611 includes a through-hole 613 formed at the center thereof so that a shaft hinge stopper 325 of the switch shaft hinge 320 is penetratingly disposed in the through-hole 613. The holder extension 615 is formed extending outwardly from a side of the holder body 611 so that the holder moving part 617 is disposed on the holder extension 615. The holder moving part 617 is formed upwardly extending from the holder extension 615 in parallel with a vertical movement direction of the switch shaft unit 300 so that when the switch shaft unit 300 is vertically moved, the holder moving part 617 moves the push switch 620. The holder moving part 617 is formed extending upwardly toward the substrate 200. When an external force is not applied to the holder moving part 617, an end of the holder moving part 617 is positioned between a light-receiving unit (not shown) and a light-emitting unit (not shown) of the push switch 620. When a push pressure force is applied to the holder moving part 617 to cause the holder moving part 617 to be moved, the holder moving part 617 is separated from the push switch 620 to generate a predetermined signal indicating a change in the position thereof.

The push switch unit 600 further includes the push return part 630 for returning the push moving part 670 to its original position after the external force applied to the holder moving part 617 is removed. The push return part 630 includes a push return body 631, a push return extension 633, and a push return rubber cap 635. The push return body 631 includes a through-hole 632 formed at the center thereof to have a predetermined ring shape so that the shaft hinge stopper 325 can be vertically moved through the through-hole 632.

The push return part 630 has a structure in which it is disposed below the push holder body 611 in such a manner that it can be in close contact with the push holder body 611. The push return extension 633 is formed extending outwardly from the outer periphery of the push return body 631. The push return rubber cap 635 is protrudingly formed upwardly from one surface of the push return extension 633. The push return body, the push return extension, and the push return rubber cap may be modified in various manners, such as being formed integrally with each other, or formed as a mutual engagement structure.

The push return rubber cap 635 elastically supports the holder extension 615 so that a vertical pressing force applied to the push holder 610 is removed to cause the push holder 610 to return its original position.

Figure 5:
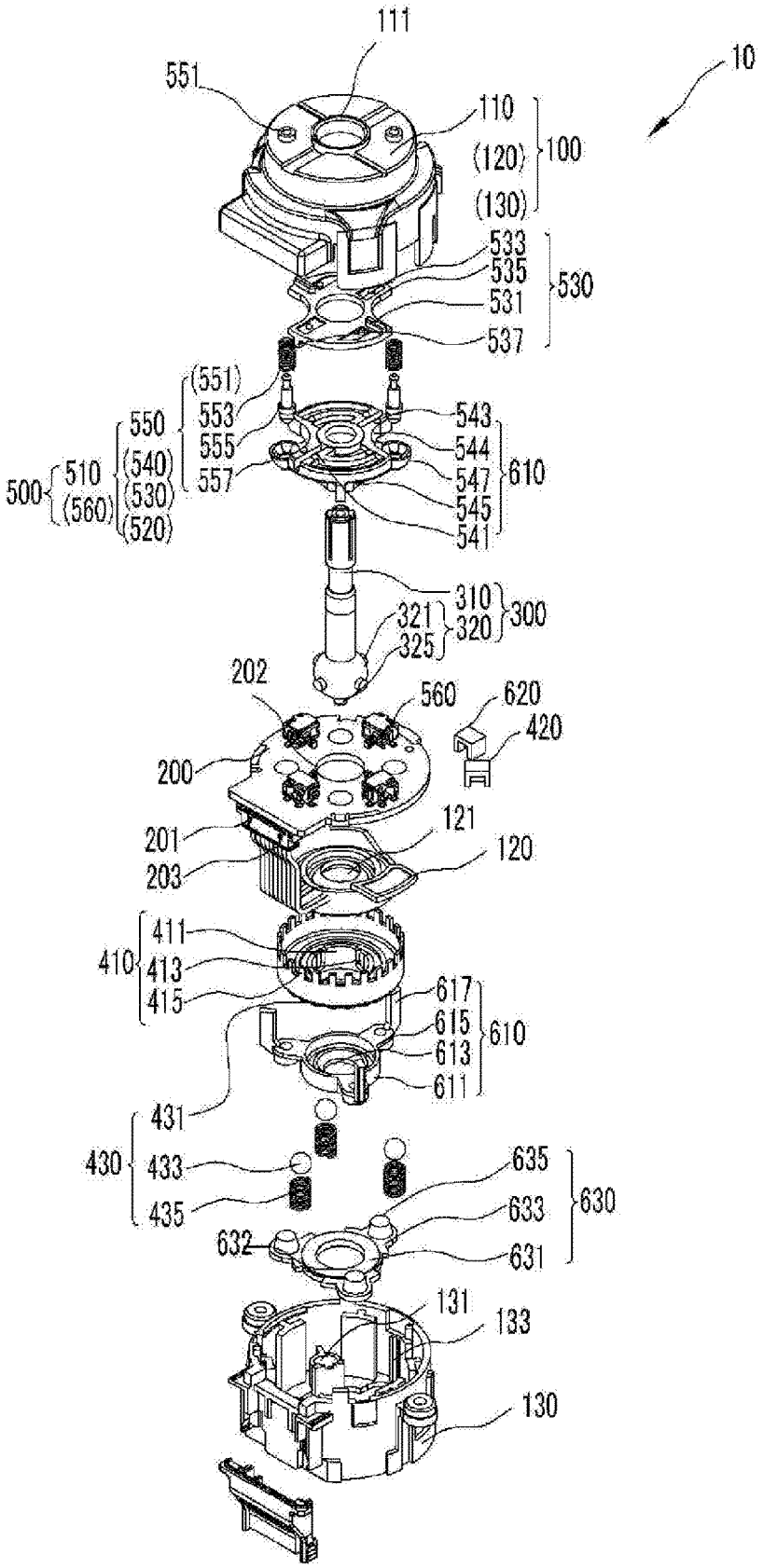
FIG. 5 is a schematic exploded perspective view illustrating a multi-operating switch device for a vehicle according to one embodiment of the present invention.
Figure 6:
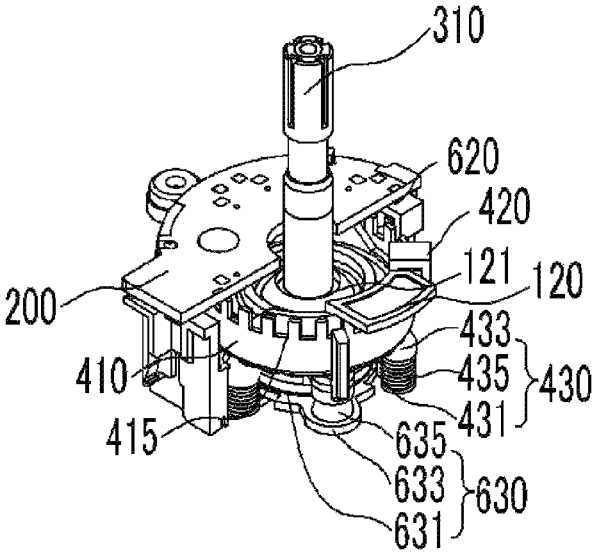
FIG. 6 is a schematic partial cut-away perspective view illustrating a multi-operating switch device for a vehicle according to one embodiment of the present invention.
Figure 7:
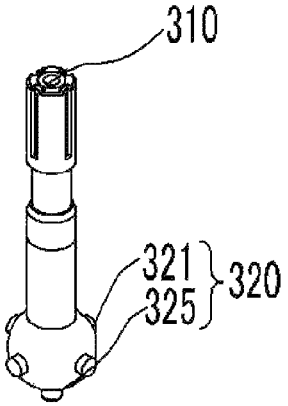
FIG. 7 is a schematic perspective view illustrating a switch shaft unit of a multi-operating switch device for a vehicle according to one embodiment of the present invention.
Figure 8:
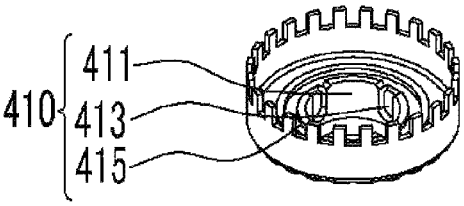
FIG. 8 is a schematic perspective view illustrating a rotary encoder of a multi-operating switch device for a vehicle according to one embodiment of the present invention.
Figure 9:
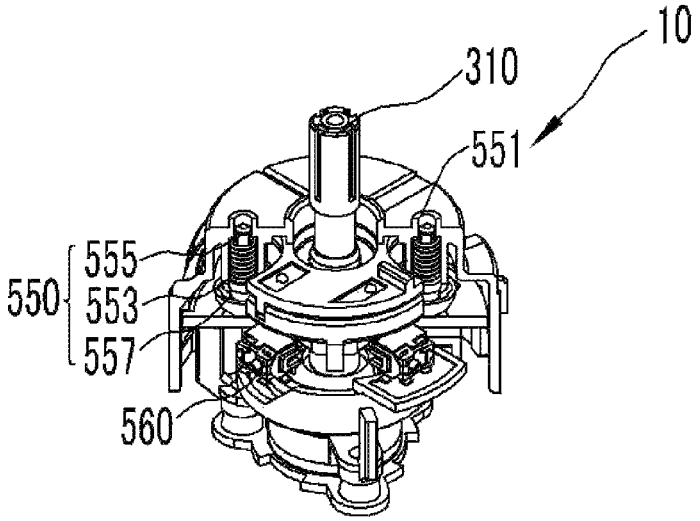
FIG. 9 is a schematic partial cut-away perspective view illustrating a multi-operating switch device for a vehicle according to one embodiment of the present invention.
Figure 10:
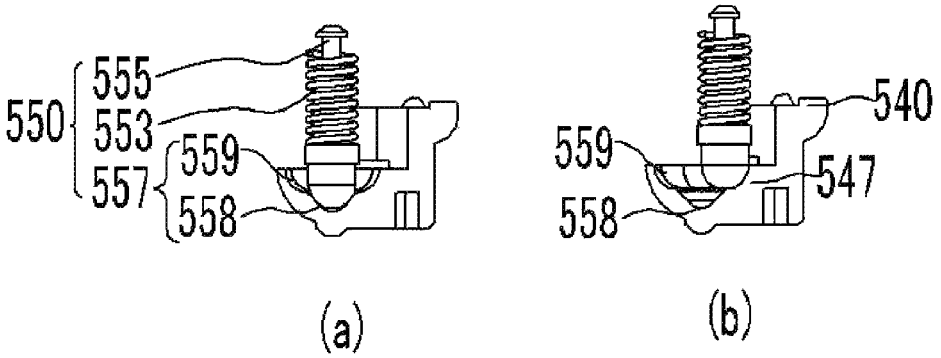
FIG. 10 is a schematic partial cut-away cross-sectional side view illustrating the operation state of a directional return part during a directional tilting operation of a multi-operating switch device for a vehicle according to one embodiment of the present invention.
Figure 11:
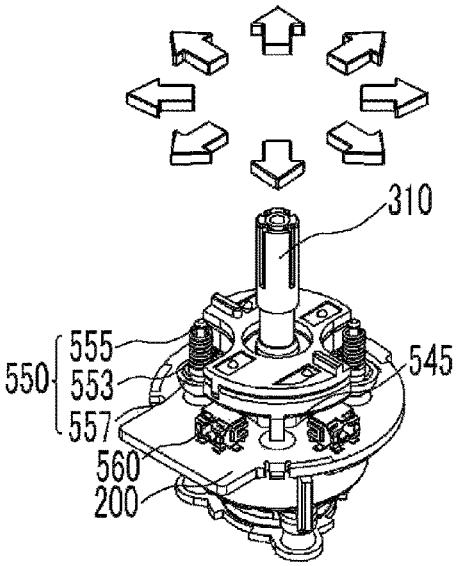
FIG. 11 is a schematic partial perspective view illustrating the operation state of a directional return part during a directional tilting operation of a multi-operating switch device for a vehicle according to one embodiment of the present invention.
Figure 12:
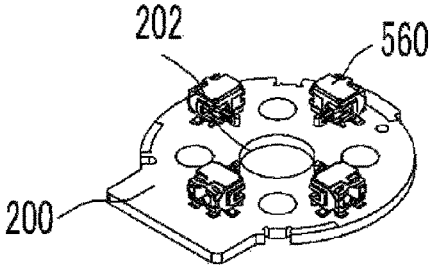
FIG. 12 is a schematic perspective view illustrating the mounting state of a directional switch of a multi-operating switch device for a vehicle according to one embodiment of the present invention.

In addition, in the case where the push holder 610 returns to its original position by the push return part, the housing base 130 may further include a guide element for allowing for a stable original position returning operation of the push holder. In other words, as shown in FIG. 5, the housing base 130 includes a base push guide 133 formed at the inside thereof so that a side end of the holder moving part 617 is insertingly guided along the base push guide 133 to form a stable relative vertical movement structure.

Meanwhile, the housing base may further include a constituent element for preventing interference of an output signal from occurring upon the simultaneous performance of undesirable two operations, for example, the push operation and the directional tilting operation. In other words, the housing base 130 includes a base push tolerance 135 formed on a bottom surface thereof to correspond to a position of the shaft hinge stopper 325, and a base push stopper 137 formed on the outer periphery of the base push tolerance 135. The base push tolerance has a predetermined recessed structure. In the case where a push operation is performed, the base push tolerance 135 allows the shaft hinge stopper 325 disposed at the lower end of the switch shaft hinge 320 to be received therein. On the other hand, in the case where a directional tilting operation is performed, when a pressure push force is applied to the switch shaft body an axial direction thereof, the shaft hinge stopper 325 can be brought into close contact with the base push stopper 137 to prevent the pressure push operation of the switch shaft body.

In the meantime, although it has been described in the above embodiment that the rotary detent part of the rotary switch unit is disposed on the underside of the rotary encoder, a structure of the rotary detent part according to the present invention is not limited thereto. FIGS. 18 to 23 show other embodiments of the multi-operating switch device for a vehicle in accordance with the present invention.

Figure 18:
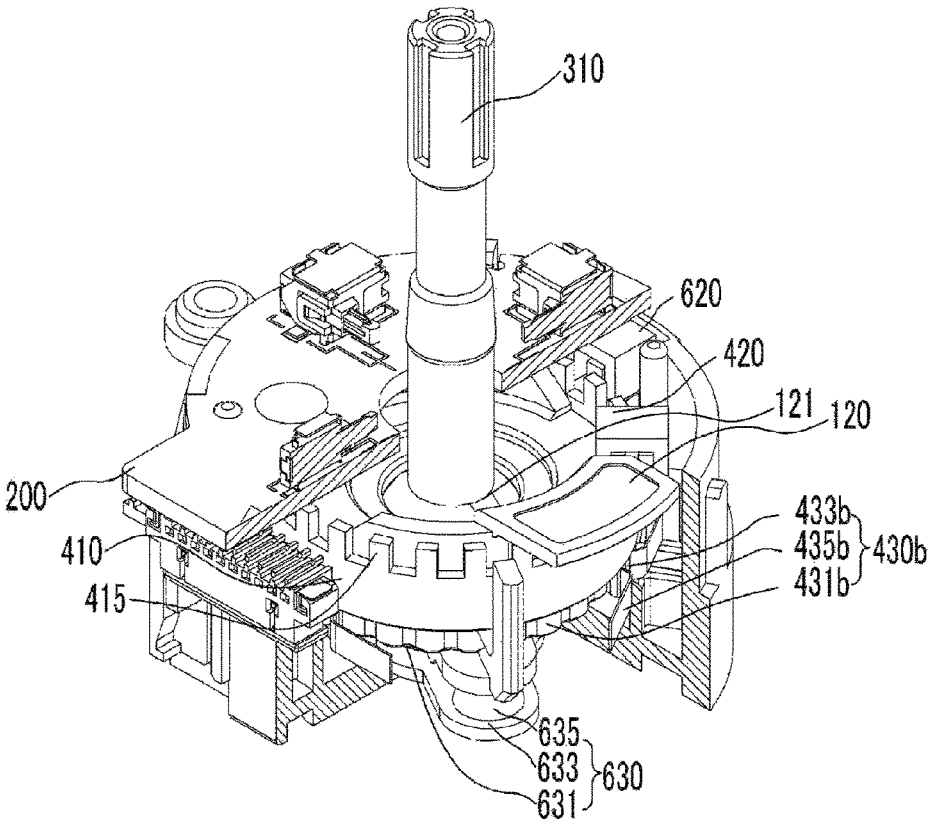
FIGS. 18 to 23 illustrate a schematic partial perspective view, a partial side cross-sectional view, and a state view of a multi-operating switch device for a vehicle according to another embodiment of the present invention.
Figure 19:
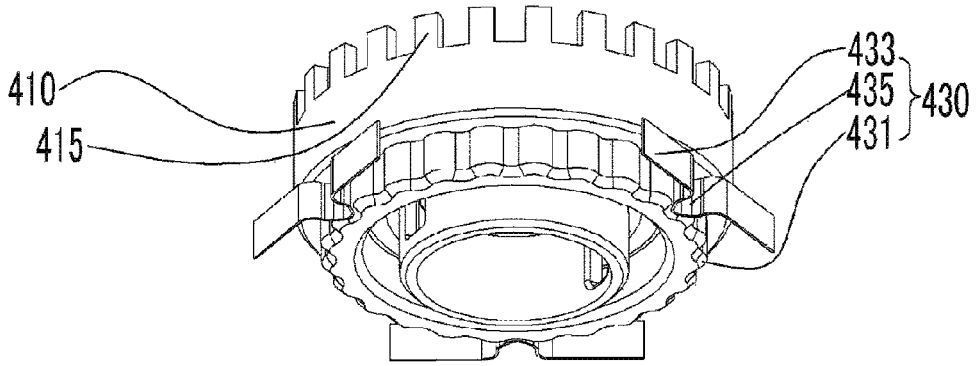
Figure 20:
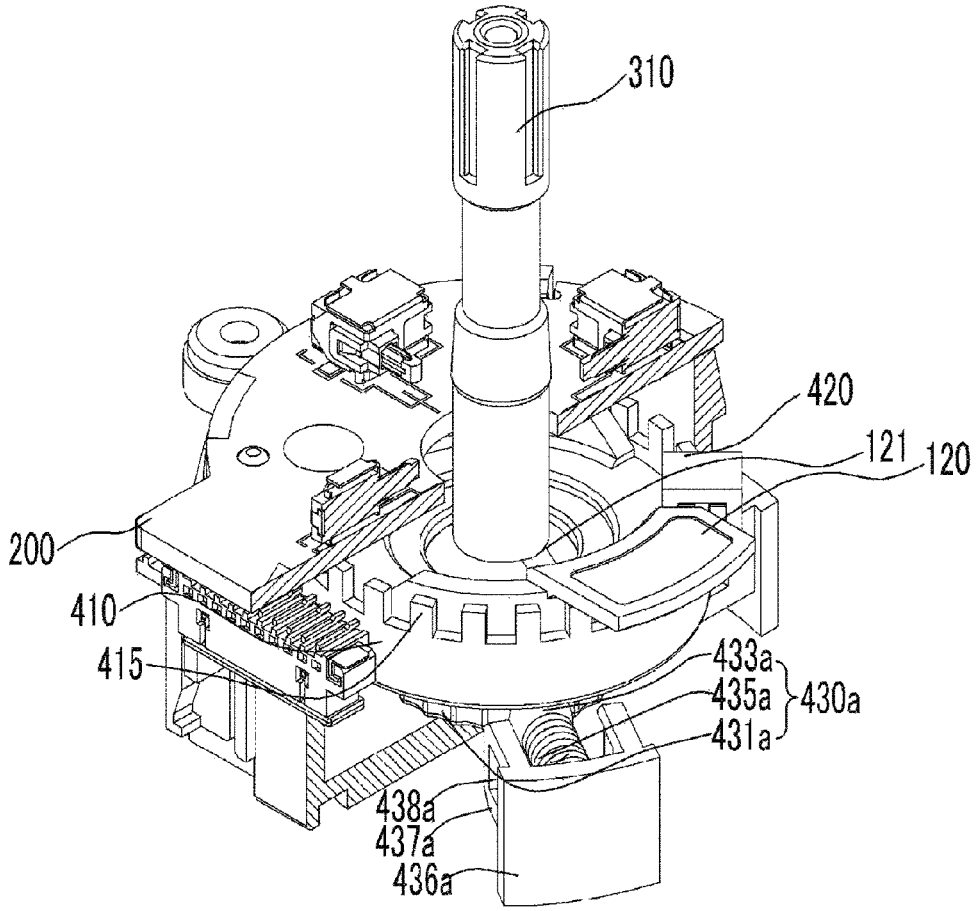
Figure 21:
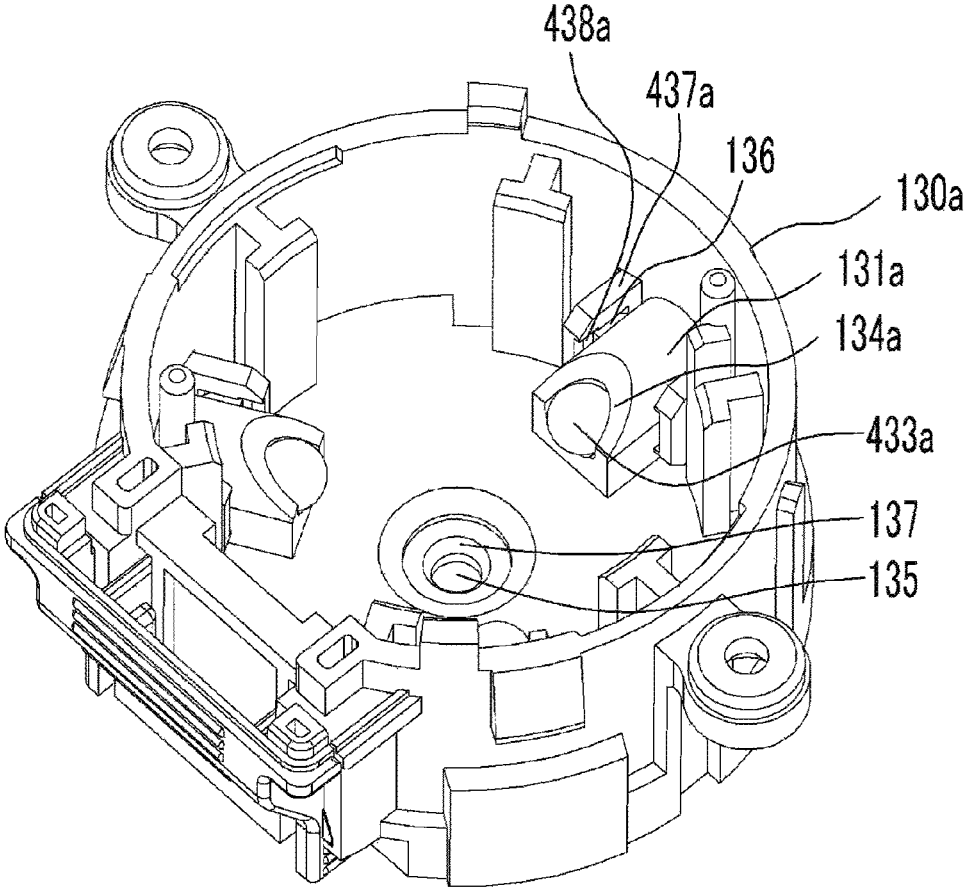

FIGS. 18 and 19 illustrate a modification of a rotary detent part **430*b*. That is, the rotary detent part 430*b* has a structure in which it is detented at a side of a lower portion of the rotary encoder 410 unlike the previous embodiment. The rotary detent part 430*b* includes a rotary detent 431*b*, a rotary detent elastic means 433*b*, and a rotary detent elastic protrusion 435*b*. The rotary encoder 410 is the same as in the previous embodiment, but the rotary detent 431*b* has a structure in which it is disposed at side of a lower portion of the rotary encoder 410. The rotary detent is formed as a structure in which one or more prominences and depressions are arranged spaced apart from each other at predetermined intervals, respectively. The rotary detent elastic means 433*b* is disposed in the housing base 130 of the housing unit 100. The rotary detent elastic means 433*b* is implemented as a leaf spring. In other words, the rotary detent elastic means 433*b* is formed as an elastic piece having a predetermined elastic force, such as a metal plate. The rotary detent elastic protrusion 435*b* is formed integrally with the rotary detent elastic means 433*b*, so as to be bently protruded from the center of the rotary detent elastic means 433*b* to maintain a continuous contact with the rotary detent 431*b***.

The rotary detent elastic means **433*b* and the rotary detent elastic protrusion 435*b* are provided in single number or plural numbers, respectively. In this embodiment, the rotary detent elastic means 433*b* and the rotary detent elastic protrusion 435*b* take a structure in which three rotary detent elastic means 433*b* and three rotary detent elastic protrusions 435*b* are respectively arranged at equal angles on a plane parallel with the rotary shaft of the rotary encoder so as to perform a smooth detenting operation and form a stable support state without being tilted to one side upon the rotation of the rotary encoder 410**.

In addition, FIGS. 20 to 23 show another modification of a detenting operation performed for the rotation of the rotary encoder at a side of a lower portion of the multi-operating switch device for a vehicle of the present invention. The rotary encoder 410 includes a plurality of rotary encoder slits 415 formed on the outer periphery thereof and the rotary switch sensor 420 is disposed at a position corresponding to the rotary encoder slits 415.

A rotary detent part 430*a* detents the rotation of the switch shaft unit 300 and the rotary encoder 410 so as to prevent an undesirable rotation of the rotary switch unit 400 as well as an erroneous operation in setting the operation states of devices of a vehicle through the rotation operation of the switch shaft unit by generating a more accurate rotation signal, and provide a sense of manipulation. The rotary detent part 430*a* includes a rotary detent 431*a*, a rotary detent ball 433*a*, and a rotary detent elastic means 435*a*.

The housing base 130 of the housing unit 100 include rotary detent receiving part 131*a*; 132*a*. The rotary detent receiving part 131*a*; 132*a* is formed radially at a side of a lower portion of the housing base 130. A detent holder 436*a* is insertingly disposed at the rotary detent receiving part 131*a*; 132*a*. The rotary detent elastic means 435*a* is brought into close contact at one end thereof with the rotary detent receiving part 131*a*; 132*a*, more specifically, the inside of the detent holder 436*a*, and is brought into close contact at the other end thereof with the rotary detent ball 433*a*. The rotary detent elastic means 435*a* provides a certain elastic force to the rotary detent ball 433*a* to maintain a continuous contact between the rotary detent ball 433*a* and the rotary detent 431*a*.

In other words, the rotary detent receiving part 131*a*; 132*a* includes a rotary detent receiving part holder through-hole 132*a* and a rotary detent receiving part guide 131*a*. The rotary detent receiving part guide 131*a* is formed on the inner surface of a lower side portion of the housing base 130, and the rotary detent receiving part holder through-hole 132*a* is formed on the outside of the rotary detent receiving part guide 131*a* at the lower side portion of the housing base 130 so as to penetrate through the housing base 130. The detent holder 436*a* includes a detent holder mounting part 437*a*. The detent holder mounting part 437*a* is inserted into the rotary detent receiving part holder through-hole 132*a* so that the detent holder 436*a* can be maintained in a stable mounting state with respect to the housing base 130.

The rotary detent receiving part guide 131*a* has a tubular structure which is formed extending radially toward the center of the housing base 130. The rotary detent receiving part guide 131*a* is formed as a structure in which both ends thereof are opened so that an insertion and assembly process of the rotary detent elastic means 435*a* can be facilitated, and a stable pressing operation of the rotary detent elastic means 435*a* can be performed. The rotary detent receiving part guide 131*a* at least partially receives the rotary detent ball 433 so that a stable operation state can be maintained through the continuous contact between the rotary detent ball 433 and the rotary detent 431*a* formed at a side of a lower portion of the rotary encoder 410. The rotary detent receiving part guide 131*a* has a guide protrusion 136 formed on the outer peripheral surface thereof, and the detent holder mounting part 437*a* of the detent holder 436*a* includes a detent holder mounting receiving part 438*a*. The guide protrusion 136 is engaged with the detent holder mounting receiving part 438*a* so that the detent holder 436*a* can be prevented from undesirably escaping from the housing base 130.

The detenting structure will be described in further detail. The rotary detent 431 has structure in which it is formed at a side of the lower portion of the rotary encoder 410, more specifically, on the outer peripheral surface of the lower portion of the encoder 410, which is perpendicular to a radial direction from the rotation center of the rotary encoder 410. The rotary detent 431 may have a structure in which the prominences and depressions are arranged spaced apart from each other at predetermined intervals, respectively. Although not shown in this embodiment, the rotary switch unit 400 may have a structure in which it further includes a rotary stopper (not shown) for preventing the excessive rotation of the rotary encoder to form a rotation restriction region, if necessary. In addition, the rotary switch unit 400 may be modified in various manners, such as having a structure of performing infinite rotation without restriction of rotation and initializing a rotation reference of the rotary switch sensor upon the turning off of the power switch.

Meanwhile, if the rotary detent part is formed as a radially arranged structure, it may additionally implement a push return function. That is, in this case, in another embodiment of the present invention, the push switch unit may be configured as a simpler structure, and may be formed integrally with the push switch unit.

In the previous embodiment, the push switch unit 600 includes a push holder 610, a push switch 620, and a push return part 630. In this embodiment, the push switch unit includes a push switch, a push moving part, and a push detent. The push switch unit may have a structure in which the return function of the push return part in the previous embodiment is performed by the rotary detent part together with the push detent, and the rotary encoder slits (or protrusions) performs a function of the push moving part and the rotary switch sensor performs a switching detection function of a push switch.

In other words, in the case where the push moving part is disposed at the rotary encoder, particularly, on a top end of the rotary encoder and the switch shaft hinge of the switch shaft unit presses the rotary encoder so as to be moved downwardly, the switch shaft hinge is moved downwardly together with the rotary encoder to generate a signal change of the push switch disposed on the substrate. In this embodiment, the rotary encoder slits function as the push moving part, and the rotary switch sensor functions as the push switch.

The push detent 630*a* is formed on an upper end of the rotary detent 431*a* at a side of the lower portion of the rotary encoder 410*a*. The push detent 630*a* forms a stacked-layer structure together with the rotary detent 431*a* in a longitudinal direction of the switch shaft unit 300 and a radial direction from the center of the switch shaft unit 300. In other words, when it is viewed from a plane through which the rotary shaft of the switch shaft unit 300 penetrates, a plane on which the push dentent 630*a* is disposed and a plane on which the rotary detent 431*a* is disposed are different from each other. That is, the plane on which the push dentent 630*a* is disposed is nearer to the housing cover 110 than that on which the rotary detent 431*a* is disposed.

In this embodiment, the rotary switch sensor 420 can additionally perform a function of the push switch. When the switch shaft unit 300 is vertically pressed by the push operation, a change in the position of the rotary encoder slits functioning as the push moving part causes a change in the signal from the rotary switch sensor. In this case, because a change in the on/off period of the signal by the push operation differs from that in the on/off period of the signal by a typical rotary operation, a configuration may be implemented in which an input state is detected based on the difference therebetween. However, this merely an embodiment of the present invention, various modifications can be made. Namely, although it has been illustrated in FIGS. 20 to 23 that the push switch unit and the rotary switch unit are integrated, the push switch unit may have a configuration in which the rotary encoder slits 415 causes a change in the signal from the push switch and the push switch is further provided independently of the rotary switch sensor. In addition, the push switch unit may be modified in various manners depending on a design specification, such as having a configuration in which a separate push switch and a separate push moving part are provided independently of the rotary switch sensor and the rotary encoder slits besides the push detent.

By virtue of this configuration, when the switch shaft unit 300 is vertically pressed, the rotary detent ball 433*a* is released from a state in which the rotary detent ball 433*a* is in close contact with the rotary detent 431*a* disposed at a side of the lower portion of the rotary encoder 410*a* which is moved downwardly together with the switch shaft unit 300, and then forms a contact with the push detent 630*a*. In this case, a detent boundary 631*a* is formed between the rotary detent 431*a* and the push detent 630*a* so that a user can easily tactically detect a conversion to the push operation. In other words, the detent boundary 631*a* is interposed between the rotary detent 431*a* and the push detent 630*a* and is formed with a curvature or a protrusion different from that of the both detents so that a user can recognize a tactical change upon the conversion of a position from a normal position to a position by the push operation through the vertical depression.

The push detent 630*a* forms an inclined surface arrangement structure having a predetermined curvature at a side of the lower end of the rotary encoder 410 to an unstable state so that when a vertical pressing force is removed, the push detent 630*a* can be released from a push pressing state by means of a restoring force of the rotary detent part to return to an original position. The push moving part causing the push switch to be moved is at least partially disposed on an upper end of the rotary encoder 410. When the switch shaft hinge of the switch shaft unit presses the rotary encoder to move the rotary encoder downwardly, it is vertically moved together with the rotary encoder. In this embodiment, the present invention takes a configuration in which the function of the rotary encoder slits 415 replace a function of the push moving part, and in which the rotary switch sensor performs a function of the push switch in which the push moving part causes a change in the electrical signal. In other words, the push switch is disposed on the substrate 200. When the push moving part 610*a* is changed in position in a vertical direction, the push switch generates a signal indicating the change in the position of the push moving part 610*a*. As mentioned above, in this embodiment, the push switch is formed integrally with the rotary switch sensor 420. In the case where the push switch is provided independently of the rotary switch sensor, if necessary, the push switch unit may have a configuration in which it is further provided with a separate push switch moving part.

In addition, the rotary detent receiving part guide 131*a* may further include another configuration at an end thereof to prevent unnecessary interference with the rotary encoder and perform a smooth operation during the push operation. In other words, the rotary detent receiving part guide 131*a* includes a chamfered part 134*a* formed at an upper end thereof, which is oriented toward the center of the housing base 130 in such a manner that a top surface of the inner end thereof is chamfered. By virtue of this chamfered part 134*a*, the top surface of the inner end of the rotary detent receiving part guide 131*a* is removed to cause a top surface of the rotary detent ball 433*a* to be at least partially exposed to the outside so that a state can be formed in which the rotary detent ball 433*a* can be brought into close contact with the push detent 630*a* in an easier and smoother manner.

Figure 22:
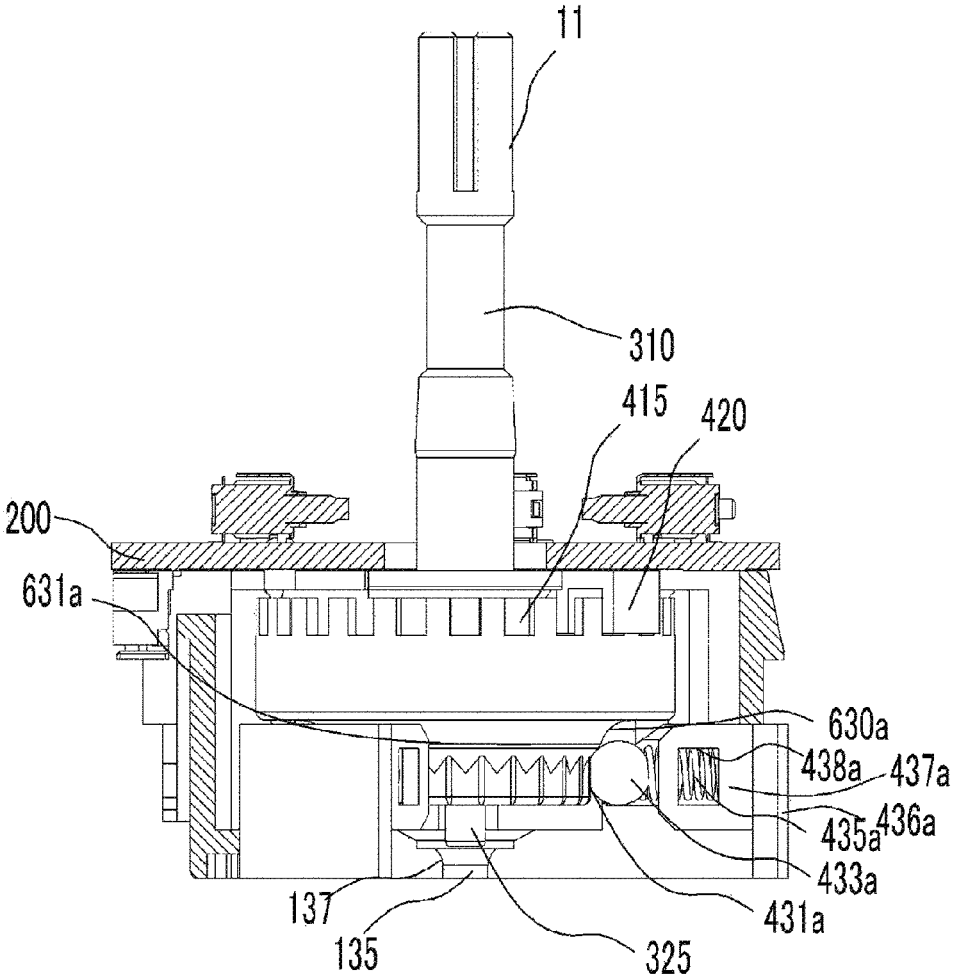
Figure 23:
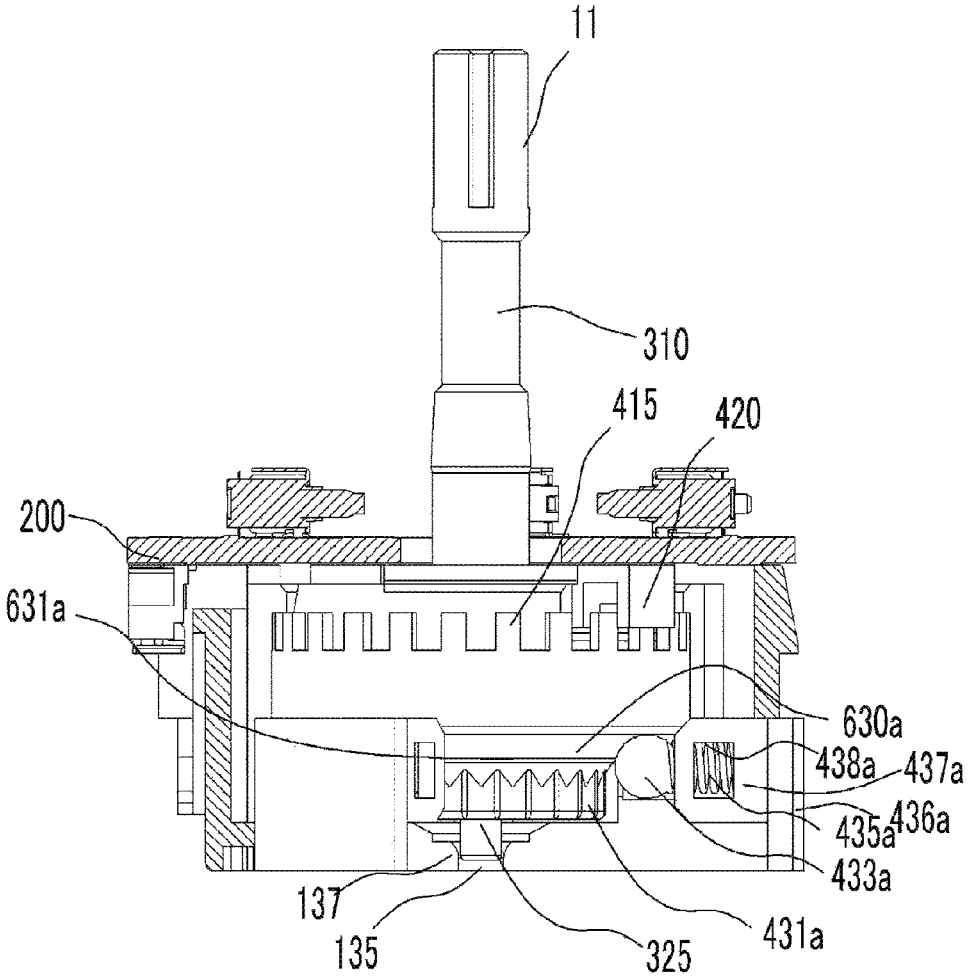
Figure 24:
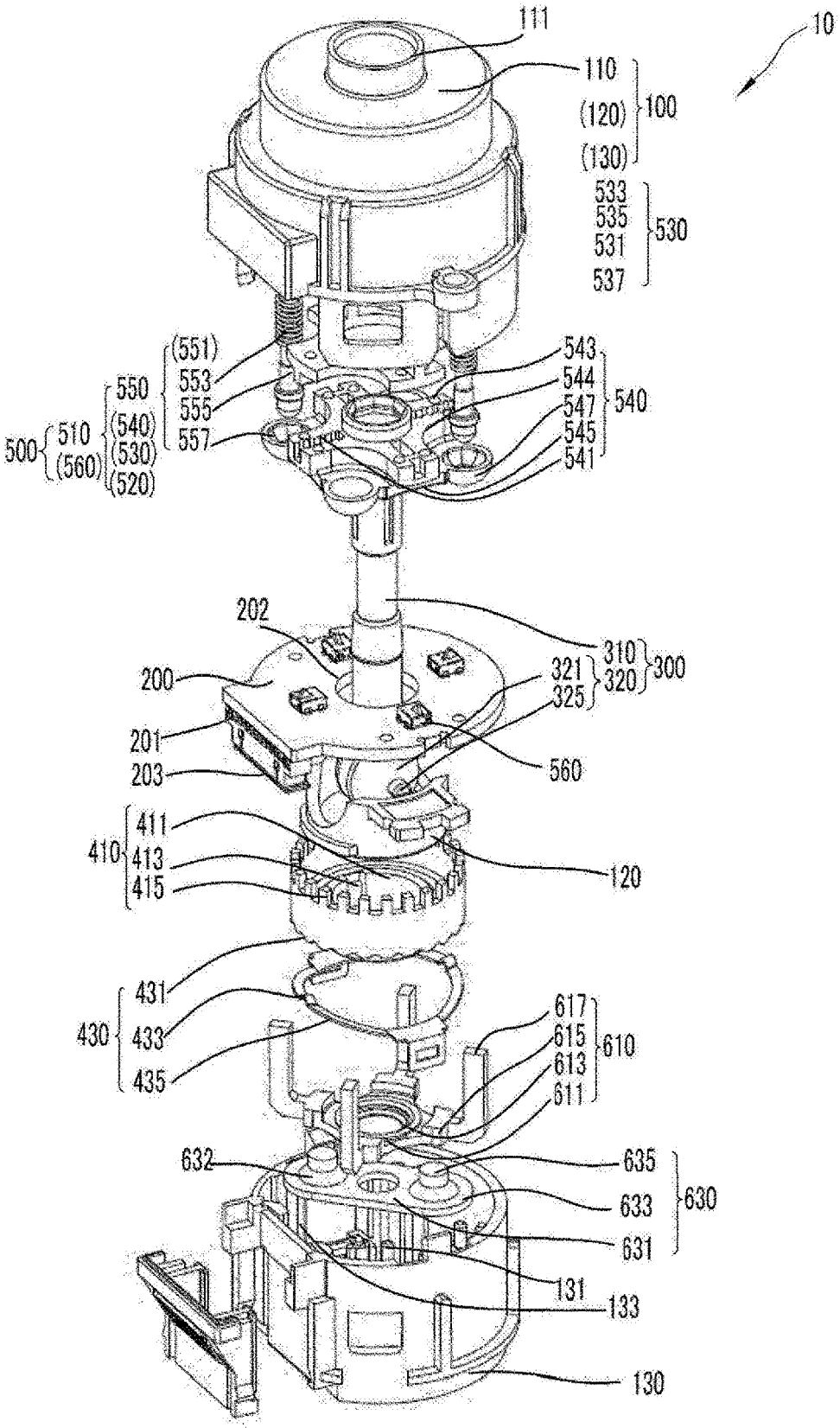
FIG. 24 is a schematic exploded perspective view illustrating a multi-operating switch device for a vehicle according to still another embodiment of the present invention.
Figure 25:
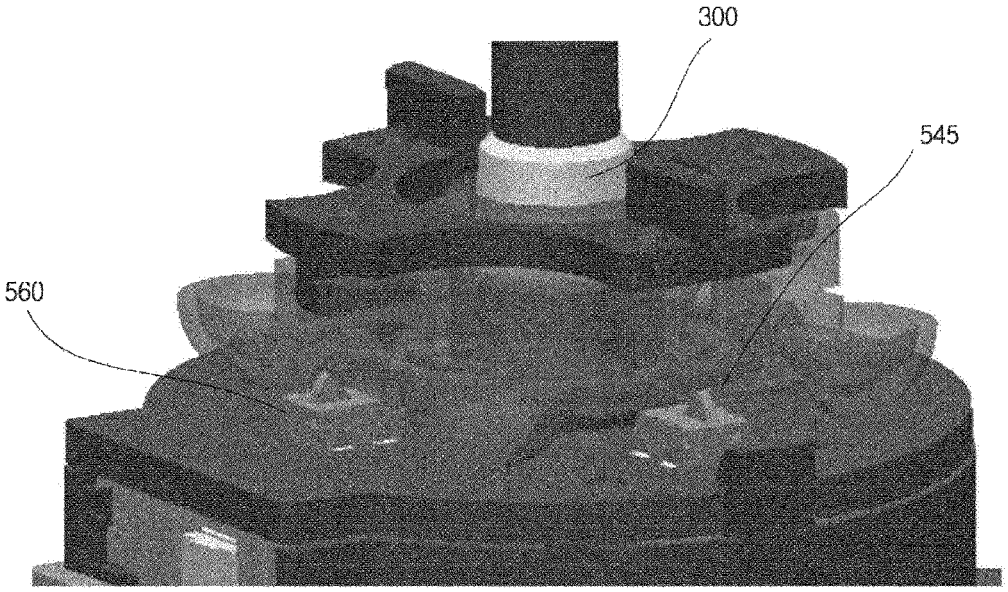
FIGS. 25 and 26 are schematic perspective views illustrating directional switches of a multi-operating switch device for a vehicle according to still another embodiment of the present invention.
Figure 26:
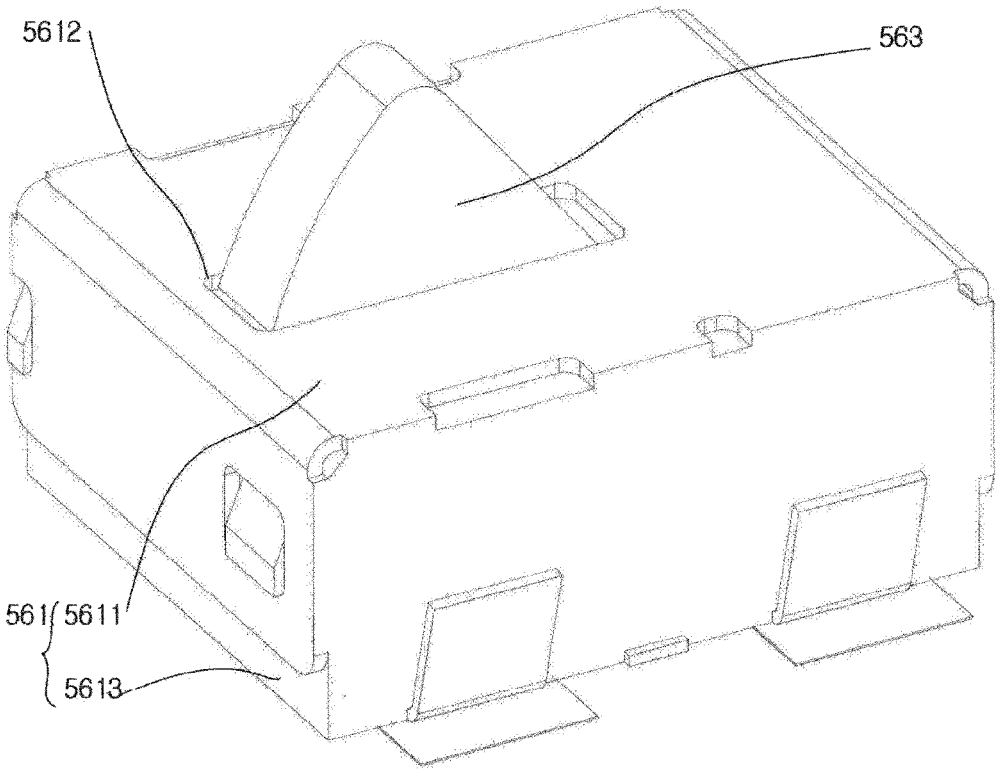

As shown in FIGS. 22 and 23, when a vertical external force is applied to the switch shaft unit, the rotary encoder 420 is vertically moved downwardly and simultaneously the push detent performing the push detenting operation for the vertical movement of the switch shaft unit shares a configuration together with the rotary detent part. Then, the rotary detent ball 433*a* is vertically moved downwardly by the push operation so that it is released from a state of being in close contact with the rotary detent 431 and then is brought into close contact with the push detent 630*a*. In this process, the rotary detent ball 433*a* goes beyond the detent boundary 631*a* to change a contact state so that a certain sense of detent can be endowed to a user.

Figure 30:
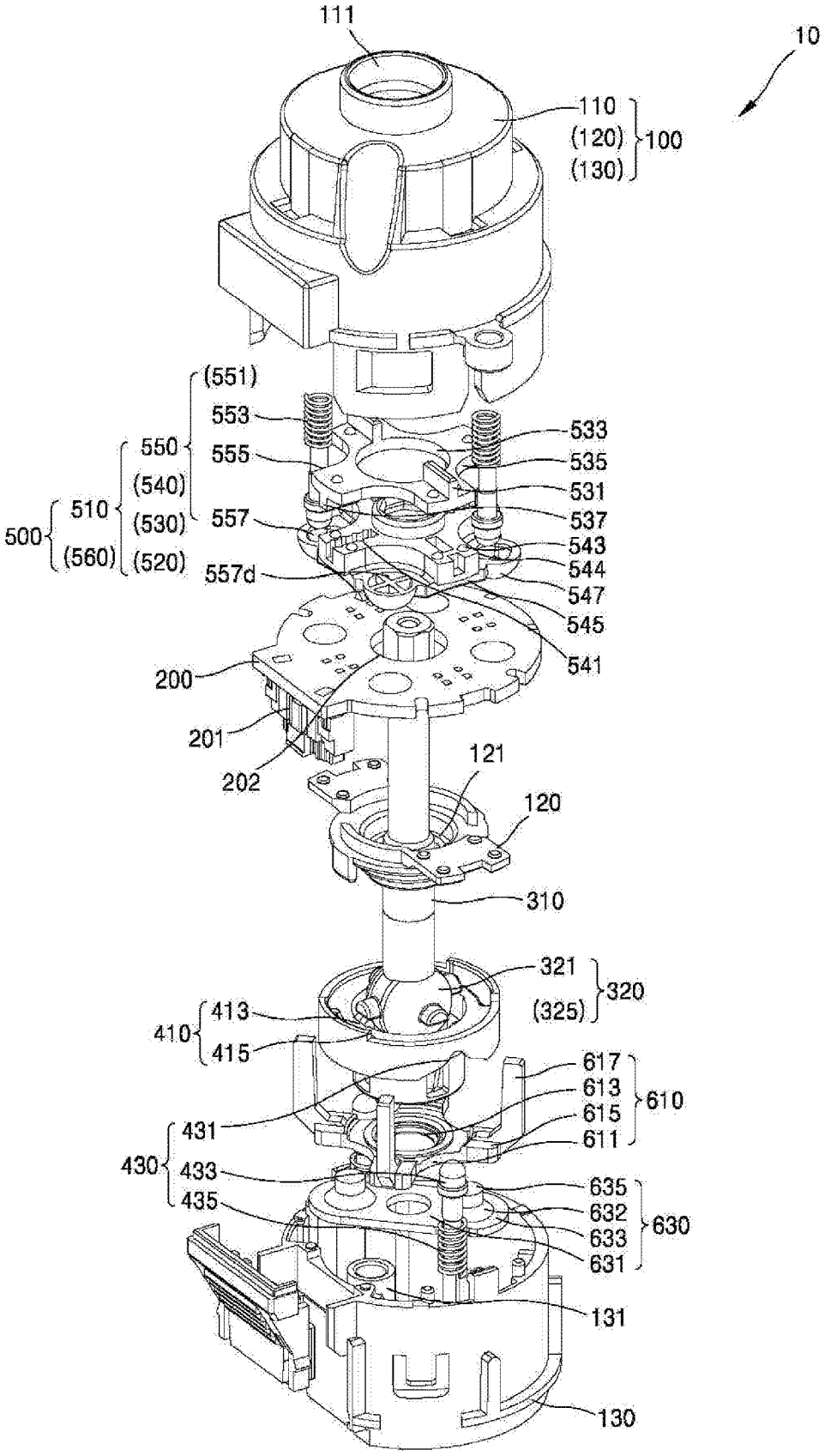
FIG. 30 is a schematic exploded perspective view illustrating a multi-operating switch device for a vehicle according to yet another embodiment of the present invention.
Figure 31:
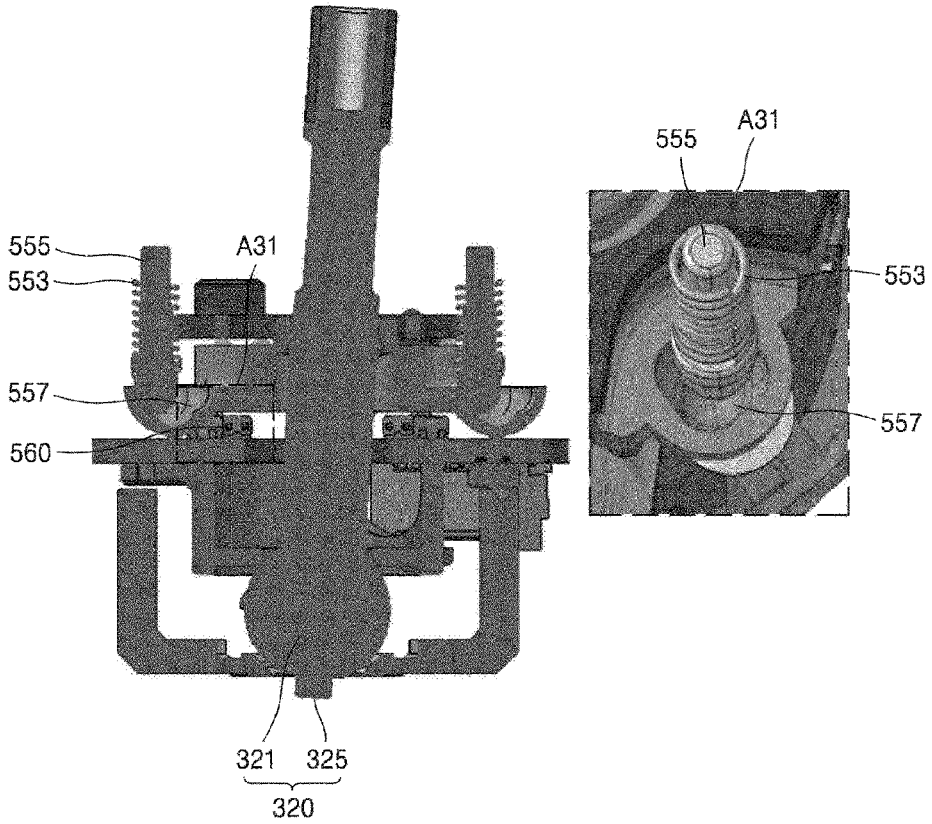
FIGS. 31 to 33 are schematic partial perspective views illustrating a push switch unit and a rotary switch unit of a multi-operating switch device for a vehicle according to yet another embodiment of the present invention.

Although it has been described in the above embodiments that the rotary switch unit is implemented as an encoder type, the present invention is not limited thereto but can be modified in various manners. In other words, FIG. 30 is a schematic exploded perspective view illustrating a multi-operating switch device for a vehicle according to yet another embodiment of the present invention.

For the multi-operating switch device 10 for a vehicle, the same reference numerals and names are used for the same elements as described above, and thus a detailed description of those elements will be omitted and a description will be made centering differences.

In this embodiment, the rotary switch unit 400 is implemented as a direct contact type switch. The rotary encoder denoted by a reference numeral 410 in the previous embodiment is replaced with a rotary block 410 in this embodiment.

In other words, the rotary switch unit 400 includes a rotary block 410 and a rotary switch sensor 420. The rotary block 410 is disposed between the substrate 200 and the housing unit 100.

The rotary block 410 has a structure in which it at least partially receives the switch shaft hinge 320. In addition, the rotary block 410 includes a rotary block receiving guide 413 on the inner surface thereof. The rotary block receiving guide 413 is engageable with a shaft hinge guide 321.

Further, in this embodiment, the rotary block 410 includes a plurality of rotary block moving parts 415 circumferentially formed on an end thereof, i.e., a top end thereof, which is oriented toward the substrate. The rotary block moving parts 415 are formed a projected or recessed shape toward the substrate 200. The rotary block moving parts 415 forms a direct contact state with the rotary switch sensor 420 which will be described later.

The rotary switch sensor 420 is disposed on the underside of the substrate 200 so that it is brought into direct contact with the rotary block moving part 415 of the rotary block 410, and the rotary block 410 is moved by a stepped portion of the rotary block moving part 415 when the rotary block 410 is rotated together with the switch shaft unit 310. In other words, the rotary block moving part 415 formed on the top end of the rotary block 410 moved by the rotation of the switch shaft unit 300 is implemented as a stepped structure having a predetermined height so that the on/off state of the rotary switch sensor 420 can be switched depending on the rotating position of the switch shaft unit 300.

The rotary block moving part 415 and the rotary switch sensor 420 are provided in plural numbers along the circumference of the rotary block so that a more accurate rotary operation signal can be implemented by confirming whether or not an erroneous operation signal is generated from the rotary switch sensors.

In addition, similar to the previous embodiment, in this embodiment, the rotary switch unit 400 may further include a rotary detent part 430 that allows the rotation of the switch shaft unit to be tactily recognized during the operation of the rotary switch unit The rotary detent part 430 serves to detent the rotation of the rotary block 410 by the rotation of the switch shaft unit 300. The rotary detent part 430 includes a rotary detent 431, a rotary detent elastic means 435, and a rotary detent rod 433.

The rotary detent 431 is disposed on the underside of the rotary block, the rotary detent elastic means 435 is received in the rotary detent receiving part 131 disposed at the housing unit 100, and the rotary detent rod 433 is elastically supported by the rotary detent elastic means 435 to maintain a continuous contact with the rotary detent 431.

In the previous embodiment, a ball type rotary detent ball has been used, but a difficulty in assembling the ball type rotary detent ball can be overcome through the rotary detent rod 433 in this embodiment.

The rotary detent rod 433 of a rod type includes a detent rod head 4331 and a detent rod body 4333. The detent rod head 4331 serves to maintain a continuous contact with the rotary detent 431, and the detent rod body 4333 is connected to the detent rod head 4331 and has a length enough to allow the rotary detent elastic means 435 to be fit therearound.

The rotary detent 431 according to this embodiment may be implemented in such a manner as to include various profiles without being limited to provision of a simple repetitive detenting tactile sensation in the previous embodiment. In other words, the rotary detent 431 according to this embodiment includes a curved profile.

Figure 32:
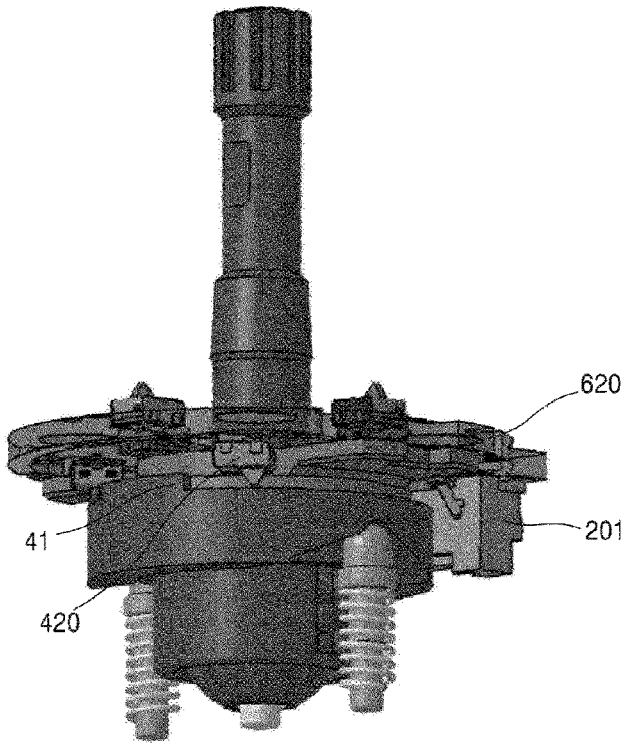
Figure 33:
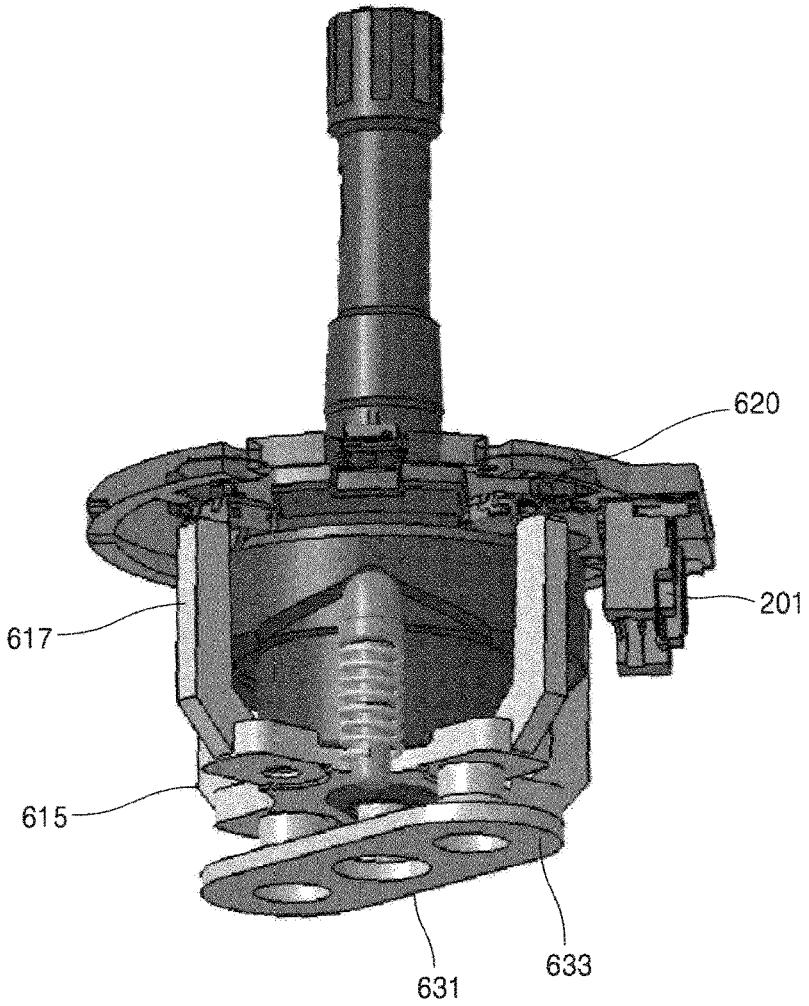

As shown in FIGS. 30, 32 and 33, the rotary detent 431 of the curved profile type includes a detent stable portion 4311 and a detent inclined portion 4313.

The detent stable portion 4311 serves to allow the detent rod head 4331 to be seated thereon when an external force is not applied to the switch shaft unit. The detent inclined portion 4313 is connected to the detent stable portion 4311, and allows the detent rod head 4331 to be brought into close contact therewith when an external force is applied to the switch shaft unit and guides the detent rod head 4331 to the detent stable portion 4311 when the external force applied to the switch shaft unit is removed. As such, after the contact position of the detent stable portion 4311 and the detent inclined portion 4313 is changed depending on whether or not the external force is applied, the switch shaft unit can return to its original position by the operation of the rotary dentent part when the external force is released.

In the meantime, similar to the previous embodiment, the push switch unit 600 includes a push holder 610, a push switch 620, and a push return part 630.

The push holder 610 is at least partially disposed below the substrate 200 and is brought into close contact with the switch shaft hinge 320 of the switch shaft unit 300 so that when the switch shaft unit 300 is vertically moved, the push holder 610 is vertically moved together with the switch shaft unit.

Figure 34:
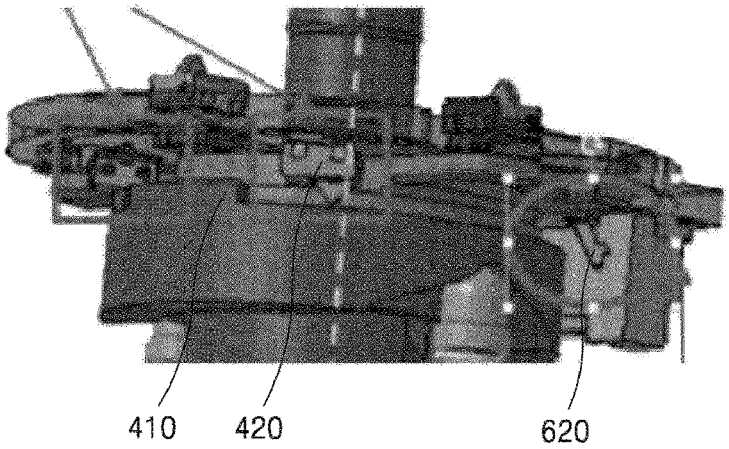
FIGS. 34 to 37 are views illustrating the operating state of a push switch unit of a multi-operating switch device for a vehicle according to yet another embodiment of the present invention.

As shown in FIG. 34, the push switch 620 is disposed on the underside of the substrate and configured to generate a signal indicating a change in position of the push holder 610 when the push holder 610 is changed in position in a vertical direction.

The push return part 630 is disposed below the push holder 610 and serves to elastically support the push holder 610.

Figure 35:
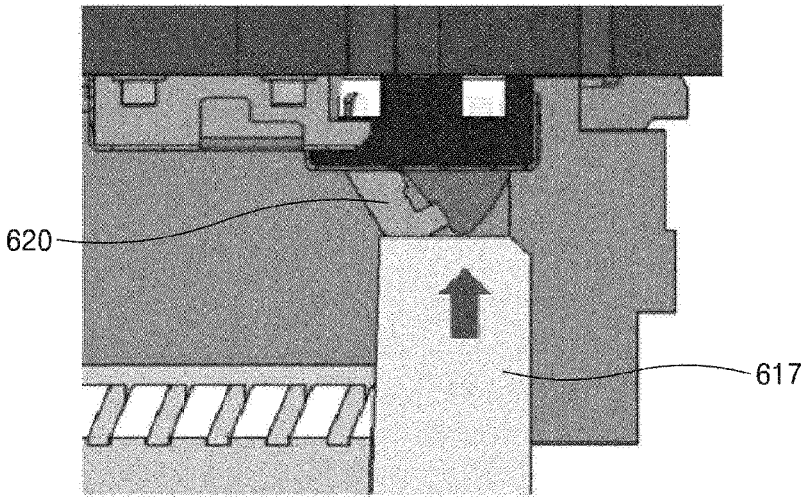
Figure 36:
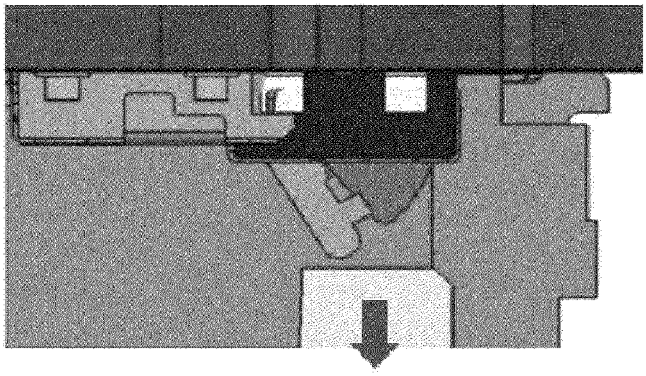
Figure 37:
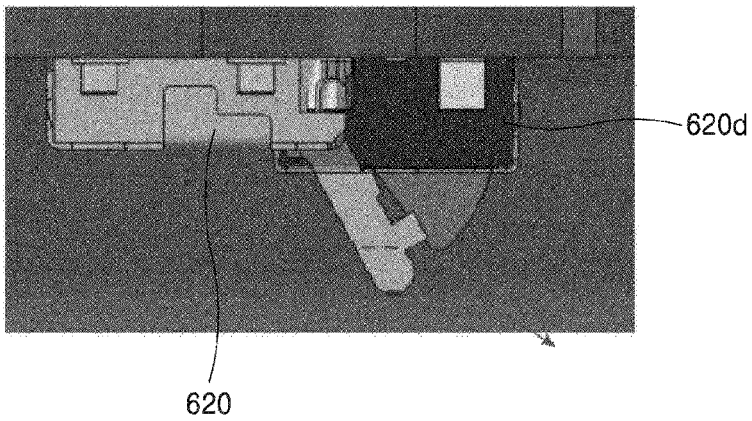

In addition, the push operation stroke of the push switch 620 is larger than the operating stroke of the rotary switch sensor 420. In FIGS. 35 to 37, there is shown a push type switch 620*d* the same as a rotary switch, which is disposed on the underside of the substrate, and the push switch 620 having a large push operation stroke. FIG. 35 shows a state in which after the push switch 620 having a large push operation stroke has performed the signal generation by the push operation, the push type switch 620*d* the same as the rotary switch starts a push operation. FIG. 36 shows a state in which even after the generation of a push operation signal from the push type switch 620*d* the same as the rotary switch after removal of an external force for the push operation has been completed, the push switch 620 having a large push operation stroke as in this embodiment is in a push stroke operation state of performing the push operation. As shown in FIG. 37, there occurs a stroke difference 5 denoted by a reference symbol between the push switch 620 having a large push operation stroke as in this embodiment and the push type switch 620*d* the same as the rotary switch.

As such, an increase in the push operation stroke can increase a design specification range so that a damage or erroneous operation of the switch can be prevented from occurring.

Meanwhile, the directional switch part 500 includes a directional slide part 510, a directional switch 560, and a directional return part 550 as described above.

The directional slide part 510 is changed in position within the housing unit 100 by the tilting directional operation of the switch shaft unit 300. The directional switch 560 is disposed on the substrate 200 and is operated by a change in the position of the directional slide part 510 to generate a signal indicating the change in the position of the directional slide part. In addition, the directional return part 550 serves to return the directional slide part 510 and the switch shaft unit 300 to their original positions. The directional return part 550 includes a return plunger 555, a return elastic part 553, and a return groove 557.

The return plunger 555 is movably disposed in the housing unit 100, the return elastic part 553 is received in the housing unit 100 to elastically support the return plunger 555, and the return groove 557 forms a continuous contact with the return plunger and includes a position for returning the return plunger 555 to its original position.

The return plunger 555 is movable in an axial direction of the switch shaft unit 300 with respect to the housing unit 100, and the return groove 557 is formed in the directional slide part 510.

The housing unit 100 include: a housing base 130 configured to support the substrate 200; and a housing cover 110 engaged with the housing base 130 to define an inner space therebetween, and including a return mounting part 551 formed thereon to allow the return plunger 555 to be movably disposed at the return mounting part.

Further, the configuration of the directional slide part 510 is substantially the same as that as in the previous embodiment. In other words, the directional slide part 510 includes a directional medium slide 530, a directional bottom slide 540, and a directional top slide 520.

The directional medium slide 530 is disposed between the housing base 130 and the housing cover 110 in such a manner that the switch shaft unit 300 penetrates through the direction medium slide.

The directional bottom slide 540 is disposed between the directional medium slide 530 and the housing base 130 in such a manner as to penetratingly fit around the outer periphery of the switch shaft unit 300.

The directional top slide 520 is formed on one surface of the housing cover 110 so as to be oriented toward the directional medium slide and is engaged with the directional medium slide in a relatively movable manner.

In this case, the implementation of a configuration of guiding the relative movement between respective slides is the same as that in the previous embodiment. In other words, the directional medium slide 530 includes: a medium upper guide 531 formed on one surface thereof so as to be engageable with the direction top slide 520; and a medium lower guide 537 formed on the other surface thereof so as to be engageable with a bottom guide 541 formed on the directional bottom slide 540 in a relatively movable manner.

The directional bottom slide 540 includes: a bottom slide body 544 including the bottom guide formed on one surface thereof, and having a bottom through-hole 542 formed at the center thereof to allow the switch shaft unit 300 to penetrate therethrough in such a manner that the bottom through-hole is in close contact at the inner peripheral surface thereof with the switch shaft unit 300; a bottom slide side 547 formed extending outwardly from a side of the bottom slide body 544 and having the return groove 557 formed thereon; and a bottom slide moving part 545 formed below the bottom slide body 544 and configured to move the directional switch.

In this case, the medium upper guide 531 and the medium lower guide 537 are arranged so as to cross each other at 90 degree angles on the same plane when viewed from the top by projection. The bottom slide side 547 is disposed at each vertex end of the bottom slide body 544, and a return dummy groove 557*d* may be formed at at least one of a plurality of the bottom slide sides 547 so as to restrict an insertion of the return plunger 555 into the return groove 557.

Figure 38:
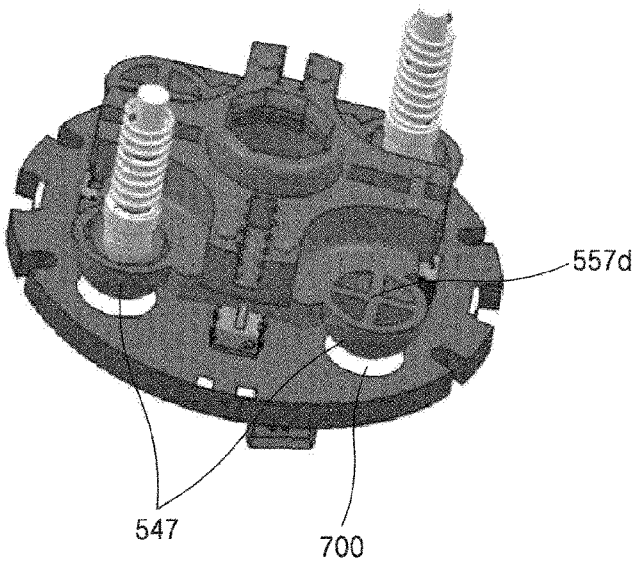
FIGS. 38 and 39 are schematic perspective views illustrating a modified state of a rotary detent part of a multi-operating switch device for a vehicle according to yet another embodiment of the present invention.
Figure 39:
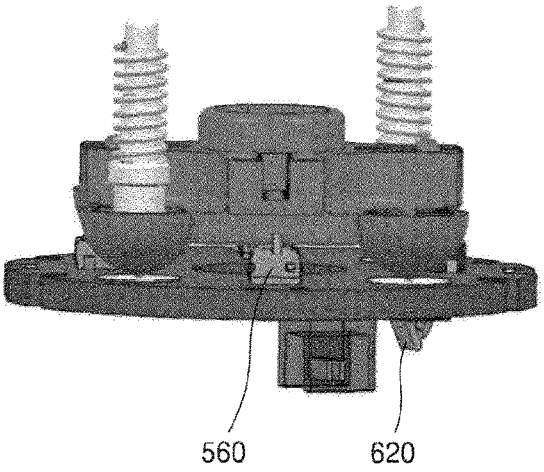

More specifically, as shown in FIGS. 38 and 39, the number of the bottom slide sides 547 disposed is four, and the return dummy groove 557*d* instead of the return groove 557 is formed at at least one of the four bottom slide sides 547 to prevent the return plunger 557 from inserted into and contacted with the return groove 557 so that an assembly worker can avoid an erroneous assembly at an unwanted position. In other words, a total of four return plungers and return grooves 557 may be correspondingly disposed and formed at four bottom slide sides 547. However, in the case where the return plunger is not disposed at four bottom slide sides 547, the return dummy groove 557*d* instead of the return groove 557 is formed at some of the bottom slide sides 547 so that it is possible to prevent an erroneous assembly due to a wrong recognition of the return plunger by an assembly worker in the case of a design structure in which the return plungers are correspondingly not disposed at the four bottom slide sides 547.

In the embodiment of the present invention, the inventive multi-operating switch device achieves a stable structure in which the return dummy groove 557*d* is arranged diagonally through a total of four bottom slide sides 547 so that a detenting structure can be formed through the engagement between two return plungers and two return grooves, which are respectively arranged diagonally and the insertion of the return plunger can be excluded at the remaining positions other than the two return plungers and the two return grooves, thereby implementing a certain detenting operation and reducing the manufacturing cost.

In the meantime, in the above embodiments, the bottom slide side 547 can form a contact with one surface of the substrate 200, and can perform an operation of guiding the contact with the substrate 200 during a directional sliding operation of the switch shaft unit. In this embodiment, the directional switch may further include a constituent element for providing an operating stroke the same or substantially the same as that in the case of a forward operation of the switch shaft unit even in the case of a diagonal direction operation besides a forward operation in a direction in which the directional switch is disposed during the tilting operation of the switch shaft unit.

Figure 40:
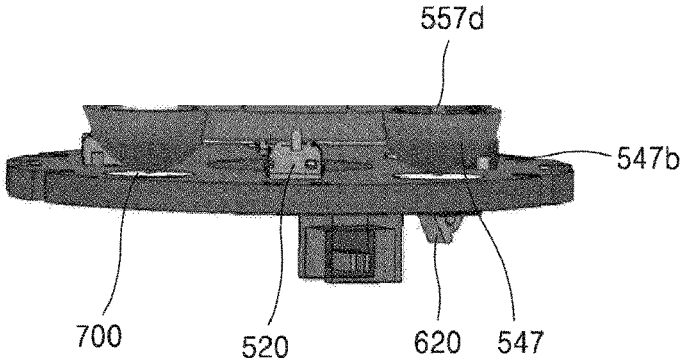
FIGS. 40 and 42 illustrate an arrangement view, a perspective view, and an operating position relationship view of a slide side guide which guides a bottom slide side while contacting with the bottom slide side of a multi-operating switch device for a vehicle according to yet another embodiment of the present invention.
Figure 41:
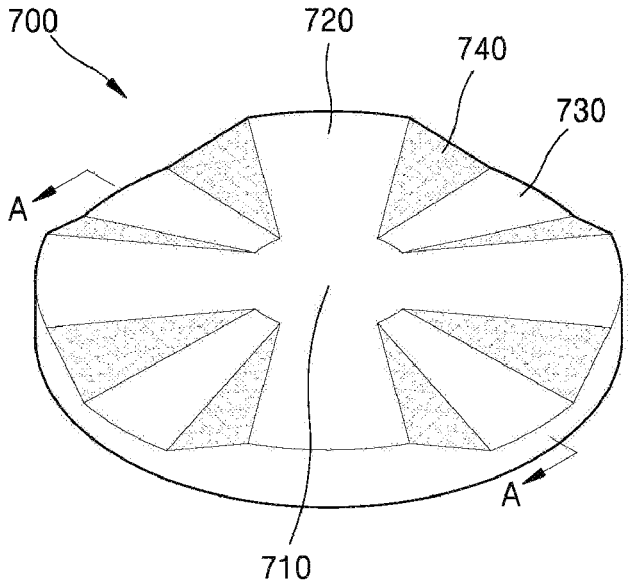

As shown in FIGS. 40 and 41, a bottom slide side contact part 547*b* contacting with the substrate 200 may be disposed below the bottom slide side 547, and a slide side guide 700 contacting with the bottom slide side contact part 547*b* may be disposed at the substrate 200.

The slide side guide 700 includes regions having differential heights from one surface of the substrate 200 depending on the contact orientation of the bottom slide side contact part 547*b*.

The slide side guide 700 includes a slide side guide hub parts 710, a plurality of slide side guide forward parts 720, and a plurality of slide side guide diagonal parts 730. The slide side guide hub parts 710 allow the bottom slide side contact part 547*b* to be brought into close contact therewith when no external force is applied to the switch shaft unit 300.

The slide side guide forward parts 720 are formed extending radially outwardly from the outer periphery of the slide side guide hub part 710 and have surfaces that are flush with each other, and each of the slide side guide diagonal parts 730 has a pair of stepped portions with heights different from those of the slide side guide forward parts 720 between two adjacent ones of the slide side guide forward parts 720.

In this embodiment, the slide side guide forward part 720 is disposed in a direction parallel to a segment disposed opposite to the directional switch 560. When it is considered that the directional medium slide 530 is formed in a cross shape, the slide side guide forward parts 720 are oriented toward respective ends from the center of the directional medium slide 530.

Figure 42:
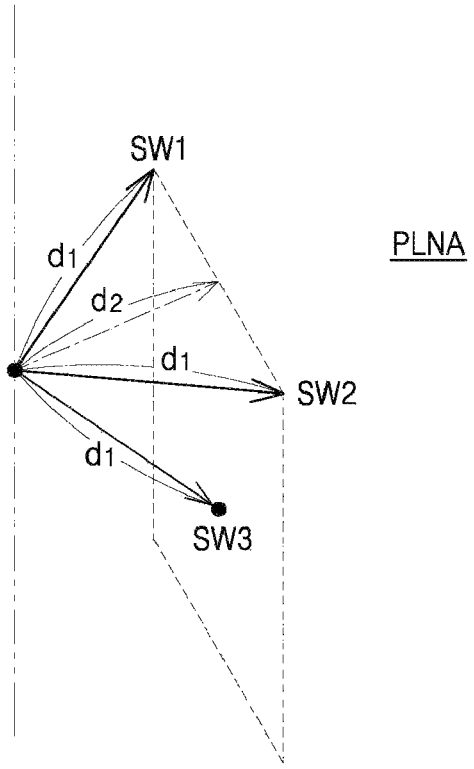

FIG. 42 illustrates a geometrical relationship in the forward and diagonal operations of the switch shaft unit. As shown in FIG. 42, when the switch shaft unit 300 is moved in a forward direction oriented toward the directional switch on the same plane having a 90-degree interval at two vertex points indicated by SW1 and SW2, it has movement distances indicated by a reference symbol d1 to perform the operation of the directional switch disposed in the forward direction. On the other hand, when the switch shaft unit 300 is moved in a diagonal direction on the same plane, it has a movement distance d2 shorter than the movement distances d1 in the forward direction to perform the operation of the directional switch so that a tilting operation can be performed in which the movement distance d2 much shorter than the movement distances d1 felt by a user for the forward direction, thereby preventing formation of a feeling of heterogeneity of the manipulation of the switch by the user, particularly a driver, which is caused by non-uniform switching stroke operation.

However, as shown in FIG. 42, when the switch shaft unit 300 is moved to a point SW3 in the diagonal direction on the vertical plane formed by SW1 and SW2, it is has the same movement distance d1 as that in the case of SW1 and SW2 so that a feeling of heterogeneity of the manipulation due to a difference in the movement distance during the manipulation of the switch by the user can be prevented from occurring.

In the meantime, as shown in FIG. 41, the slide guide 700 may further include a configuration which allows for a continuous contact movement to prevent the occurrence of a feeling of heterogeneity of the manipulation of the switch due to the stepped portions formed between the slide side guide forward parts 720 and the slide side guide diagonal parts 730. In other words, the slide side guide 700 includes a slide side guide inclined part 740 inclindedly disposed between each of the slide side guide forward parts 720 and each of the slide side guide diagonal parts 730 so that a feeling of heterogeneity of the manipulation during the tilting operation of the switch shaft unit due to a continuous contact with the bottom slide side contact part 547*b* can be prevented from occurring.

While the present invention has been described in connection with the exemplary embodiments illustrated in the drawings, they are merely illustrative and the invention is not limited to these embodiments. It will be appreciated by a person having an ordinary skill in the art that various equivalent modifications and variations of the embodiments can be made without departing from the spirit and scope of the present invention. Therefore, the true technical scope of the present invention should be defined by the technical sprit of the appended claims.

INDUSTRIAL APPLICABILITY

The multi-operating switch device for a vehicle in accordance with the present invention has been described centering on the application thereof to vehicles, but it can be used in a wide variety of devices within a range of converting an operation performed by a physical manipulation of various electronic devices into an electrical signal and outputting the electrical signal to an object to be operated.

The invention claimed is:

1. A multi-operating switch device for a vehicle, comprising: a housing unit; a substrate disposed within the housing unit; a switch shaft unit movably disposed so as to be received at one end thereof in the housing unit and exposed at the other end thereof to the outside of the housing unit; a rotary switch unit configured to detect the axial rotation of the switch shaft unit and output a signal indicating the detection of the axial rotation; a directional switch unit configured to detect a tilting directional operation of the switch shaft unit and output a signal indicating detection of the tilting directional operation; and a push switch unit configured to detect a pressure type push operation of the switch shaft unit and output a signal indicating the detection of the pressure type push operation, wherein the directional switch unit comprises:

a directional slide part configured to be changed in position within the housing unit by the tilting directional operation of the switch shaft unit;

a directional switch disposed on the substrate, and configured to be operated by a change in the position of the directional slide part to generate a signal indicating the change in the position of the directional slide part; and a directional return part configured to return the directional slide part and the switch shaft unit to their original positions on a plane, wherein the directional switch comprises:

a directional switch housing disposed on one surface of the substrate; and a directional switch knob disposed to be at least partially exposed to the outside from one surface of the directional switch housing so as to be in close contact with the directional slide part so that when the directional switch knob is pressedly rotated pivotally about one point at the inside of the directional switch housing, i.e., about an axis parallel with the substrate, it is received in the directional switch housing.

2. The multi-operating switch device for a vehicle according to claim 1, wherein the directional switch knob is disposed radially from the center of the switch shaft unit, and a rotational center of the directional switch knob, which is horizontal to the substrate is positioned adjacent to an end of the directional switch knob in the longitudinal direction of the directional switch knob so as to be oriented toward the center of the switch shaft unit.

3. The multi-operating switch device for a vehicle according to claim 2, wherein the directional switch knob comprises:

a directional switch elastic part configured to provide an elastic restoring force to the directional switch knob in the directional switch housing;

a directional switch movable contact configured to be moved by the directional switch knob; and a directional switch fixed contact disposed so as to be contactable with the directional switch movable contact when the directional switch movable contact is moved by the directional switch knob.

4. A multi-operating switch device for a vehicle, comprising: a housing unit; a substrate disposed within the housing unit; a switch shaft unit movably disposed so as to be received at one end thereof in the housing unit and exposed at the other end thereof to the outside of the housing unit; a rotary switch unit configured to detect the axial rotation of the switch shaft unit and output a signal indicating the detection of the axial rotation; a directional switch unit configured to detect a tilting directional operation of the switch shaft unit and output a signal indicating detection of the tilting directional operation; and a push switch unit configured to detect a pressure type push operation of the switch shaft unit and output a signal indicating the detection of the pressure type push operation, wherein the switch shaft unit (300) comprises:

a switch shaft hinge (320) disposed at one end thereof so as to be hingeably received within the housing unit and including a shaft hinge guide (321) formed on the outer periphery thereof; and a switch shaft body (310) of a predetermined length connected to the switch shaft hinge (320) and configured to be exposed at one end thereof to the outside from the housing unit, and wherein the rotary switch unit (400) comprises:

a rotary block (410) disposed between the substrate (200) and the housing unit (100) and configured to at least partially receive the switch shaft hinge (320), the rotary block including a rotary block receiving guide (413) formed on the inner periphery thereof so as to be engageable with the shaft hinge guide (321) and a plurality of rotary block moving parts (415) circumferentially formed on an end thereof, which is oriented toward the substrate; and a rotary switch sensor (420) disposed on the underside of the substrate (200) so as to be brought into direct contact with the rotary block moving part (415) of the rotary block (410) and configured to be moved by a stepped portion of the rotary block moving part (415) when the rotary block (410) is axially rotated together with the switch shaft unit (300).

5. The multi-operating switch device for a vehicle according to claim 4, wherein the rotary switch unit (400) further comprises a rotary detent part (430) configured to detent the rotation of the rotary block (410).

6. The multi-operating switch device for a vehicle according to claim 5, wherein the rotary detent part (430) comprises:

a rotary detent (431) disposed on the underside of the rotary block;

a rotary detent elastic means (435) received in a rotary detent receiving part (131) disposed in the housing unit (100); and a rotary detent rod (433) elastically supported by the rotary detent elastic means (435) to maintain a continuous contact with the rotary detent (431).

7. The multi-operating switch device for a vehicle according to claim 6, wherein the rotary detent rod (433) comprises:

a detent rod head (4331) configured to maintain a continuous contact with the rotary detent (431); and a detent rod body (4333) connected to the detent rod head (4331) and having a length enough to allow the rotary detent elastic means (435) to be fit therearound.

8. The multi-operating switch device for a vehicle according to claim 7, wherein the rotary detent (431) comprises a curved profile.

9. The multi-operating switch device for a vehicle according to claim 8, wherein the rotary detent (431) comprises:

a detent stable portion (4311) configured to allow the detent rod head (4331) to be seated thereon when an external force is not applied to the switch shaft unit; and a detent inclined portion (4313) connected to the detent stable portion (4311), the detent inclined portion being configured to allow the detent rod head (4331) to be brought into close contact therewith when an external force is applied to the switch shaft unit and guide the detent rod head (4331) to the detent stable portion (4311) when the external force applied to the switch shaft unit is removed.

10. The multi-operating switch device for a vehicle according to claim 4, wherein the push switch unit comprises:

a push holder (610) at least partially disposed below the substrate and configured to be brought into close contact with the switch shaft hinge of the switch shaft unit so that when the switch shaft unit is vertically moved, the push holder is vertically moved together with the switch shaft unit;

a push switch (620) disposed on the underside of the substrate and configured to generate a signal indicating a change in position of the push holder when the push holder is changed in position in a vertical direction; and a push return part (630) disposed below the push holder and configured to elastically support the push holder.

11. The multi-operating switch device for a vehicle according to claim 10, wherein the push operation stroke of the push switch (620) is larger than the operating stroke of the rotary switch sensor (420).

12. The multi-operating switch device for a vehicle according to claim 9, wherein the directional switch unit (500) comprises:

a directional slide part (510) configured to be changed in position within the housing unit (100) by the tilting directional operation of the switch shaft unit (300);

a directional switch (560) disposed on the substrate (200), and configured to be operated by a change in the position of the directional slide part (510) to generate a signal indicating the change in the position of the directional slide part; and a directional return part (550) configured to return the directional slide part (510) and the switch shaft unit (300) to their original positions.

13. The multi-operating switch device for a vehicle according to claim 12, wherein the directional return part (550) comprises:

a return plunger (555) movably disposed in the housing unit (100);

a return elastic part (553) received in the housing unit and configured to elastically support the return plunger; and a return groove (557) configured to form a continuous contact with the return plunger and including a position for returning the return plunger to its original position, and wherein the return plunger (555) is movable in an axial direction of the switch shaft unit (300) with respect to the housing unit, and the return groove (557) is formed in the directional slide part (510).

14. The multi-operating switch device for a vehicle according to claim 13, wherein the housing unit (100) comprises;

a housing base (130) configured to support the substrate (200); and a housing cover (110) engaged with the housing base (130) to define an inner space therebetween, and including a return mounting part (551) formed thereon to allow the return plunger (555) to be movably disposed at the return mounting part.

15. The multi-operating switch device for a vehicle according to claim 14, wherein the direction slide part (510) comprises:

a directional medium slide (530) disposed between the housing base (130) and the housing cover (110) in such a manner that the switch shaft unit (300) penetrates through the direction medium slide;

a directional bottom slide (540) disposed between the directional medium slide (530) and the housing base (130) in such a manner as to penetratingly fit around the outer periphery of the switch shaft unit (300); and a directional top slide (520) formed on one surface of the housing cover (110) so as to be oriented toward the directional medium slide and configured to be engaged with the directional medium slide in a relatively movable manner.

16. The multi-operating switch device for a vehicle according to claim 15, wherein the directional medium slide (530) comprises:

a medium upper guide (531) formed on one surface thereof so as to be engageable with the direction top slide (520); and a medium lower guide (537) formed on the other surface thereof so as to be engageable with a bottom guide (541) formed on the directional bottom slide (540) in a relatively movable manner.

17. The multi-operating switch device for a vehicle according to claim 16, wherein the directional bottom slide (540) comprises:

a bottom slide body (544) including the bottom guide formed on one surface thereof, and having a bottom through-hole (542) formed at the center thereof to allow the switch shaft unit (300) to penetrate therethrough in such a manner that the bottom through-hole is in close contact at the inner peripheral surface thereof with the switch shaft unit (300);

a bottom slide side (547) formed extending outwardly from a side of the bottom slide body (544) and having the return groove (557) formed thereon; and a bottom slide moving part (545) formed below the bottom slide body (544) and configured to move the directional switch.

18. A multi-operating switch device for a vehicle, comprising: a housing unit; a substrate disposed within the housing unit; a switch shaft unit movably disposed so as to be received at one end thereof in the housing unit and exposed at the other end thereof to the outside of the housing unit; a rotary switch unit configured to detect the axial rotation of the switch shaft unit and output a signal indicating the detection of the axial rotation; a directional switch unit configured to detect a tilting directional operation of the switch shaft unit and output a signal indicating detection of the tilting directional operation; and a push switch unit configured to detect a pressure type push operation of the switch shaft unit and output a signal indicating the detection of the pressure type push operation, wherein the switch shaft unit (300) comprises:

a switch shaft hinge (320) disposed at one end thereof so as to be hingeably received within the housing unit and including a shaft hinge guide (321) formed on the outer periphery thereof; and a switch shaft body (310) of a predetermined length connected to the switch shaft hinge (320) and configured to be exposed at one end thereof to the outside from the housing unit, wherein the rotary switch unit (400) comprises:

a rotary block (410) disposed between the substrate (200) and the housing unit (100) and configured to at least partially receive the switch shaft hinge (320), the rotary block including a rotary block receiving guide (413) formed on the inner periphery thereof so as to be engageable with the shaft hinge guide (321) and a plurality of rotary block moving parts (415) circumferentially formed on an end thereof, which is oriented toward the substrate; and a rotary switch sensor (420) disposed on the underside of the substrate (200) so as to be brought into direct contact with the rotary block moving part (415) of the rotary block (410) and configured to be moved by a stepped portion of the rotary block moving part (415) when the rotary block (410) is axially rotated together with the switch shaft unit (300), wherein the directional switch unit (500) comprises:

a directional slide part (510) configured to be changed in position within the housing unit (100) by the tilting directional operation of the switch shaft unit (300);

a directional switch (560) disposed on the substrate (200), and configured to be operated by a change in the position of the directional slide part (510) to generate a signal indicating the change in the position of the directional slide part; and a directional return part (550) configured to return the directional slide part (510) and the switch shaft unit (300) to their original position, wherein the directional return part (550) comprises:

a return plunger (555) movably disposed in the housing unit (100);

a return elastic part (553) received in the housing unit and configured to elastically support the return plunger; and a return groove (557) configured to form a continuous contact with the return plunger and including a position for returning the return plunger to its original position, and wherein the return plunger (555) is movable in an axial direction of the switch shaft unit (300) with respect to the housing unit, and the return groove (557) is formed in the directional slide part (510), wherein the housing unit (100) comprises;

a housing base (130) configured to support the substrate (200); and a housing cover (110) engaged with the housing base (130) to define an inner space therebetween, and including a return mounting part (551) formed thereon to allow the return plunger (555) to be movably disposed at the return mounting part, wherein the direction slide part (510) comprises:

a directional medium slide (530) disposed between the housing base (130) and the housing cover (110) in such a manner that the switch shaft unit (300) penetrates through the direction medium slide;

a directional bottom slide (540) disposed between the directional medium slide (530) and the housing base (130) in such a manner as to penetratingly fit around the outer periphery of the switch shaft unit (300); and a directional top slide (520) formed on one surface of the housing cover (110) so as to be oriented toward the directional medium slide and configured to be engaged with the directional medium slide in a relatively movable manner, wherein the directional medium slide (530) comprises:

a medium upper guide (531) formed on one surface thereof so as to be engageable with the direction top slide (520); and a medium lower guide (537) formed on the other surface thereof so as to be engageable with a bottom guide (541) formed on the directional bottom slide (540) in a relatively movable manner, wherein the directional bottom slide (540) comprises:

a bottom slide body (544) including the bottom guide formed on one surface thereof, and having a bottom through-hole (542) formed at the center thereof to allow the switch shaft unit (300) to penetrate therethrough in such a manner that the bottom through-hole is in close contact at the inner peripheral surface thereof with the switch shaft unit (300);

a bottom slide side (547) formed extending outwardly from a side of the bottom slide body (544) and having the return groove (557) formed thereon; and a bottom slide moving part (545) formed below the bottom slide body (544) and configured to move the directional switch, and wherein a bottom slide side contact part (547*b*) contacting with the substrate (200) is disposed below the bottom slide side (547), and a slide side guide (700) contacting with the bottom slide side contact part (547*b*) is disposed at the substrate (200).

19. The multi-operating switch device for a vehicle according to claim 18, wherein the slide side guide (700) comprises regions having differential heights from one surface of the substrate (200) depending on the contact orientation of the bottom slide side contact part (547*b*).

20. The multi-operating switch device for a vehicle according to claim 19, wherein the slide side guide (700) comprises:

a slide side guide hub part (710) configured to allow the bottom slide side contact part (547*b*) to be brought into close contact therewith when no external force is applied to the switch shaft unit (300);

one or more slide side guide forward parts (720) formed extending radially outwardly from the outer periphery of the slide side guide hub part (710) and having surfaces that are flush with each other; and one or more slide side guide diagonal parts (730), each of which has stepped portions with heights different from those of the slide side guide forward parts (720) between two adjacent ones of the slide side guide forward parts (720).

* * * * *